United States Patent [19]

Miyoshi et al.

[11] Patent Number: 4,515,465

[45] Date of Patent: May 7, 1985

[54] ELECTROSTATIC COPYING APPARATUS

[75] Inventors: Hideo Miyoshi, Habikino; Tadashi Umeda, Yamato Takada; Takashi Aoki, Kusatsu, all of Japan

[73] Assignee: Mita Industrial Company Limited, Japan

[21] Appl. No.: 464,833

[22] Filed: Feb. 8, 1983

Related U.S. Application Data

[62] Division of Ser. No. 250,829, Apr. 3, 1981, abandoned.

[30] Foreign Application Priority Data

Apr. 15, 1980 [JP] Japan ..... 55-49497

[51] Int. Cl.[3] ..... G03G 15/00

[52] U.S. Cl. ..... 355/14 C; 355/15

[58] Field of Search ..... 355/15, 3 R, 3 DD, 14 R, 355/14 D, 3 BE

[56] References Cited

U.S. PATENT DOCUMENTS

| | | | |
|---|---|---|---|
| 3,637,306 | 1/1972 | Cooper | 355/15 |
| 3,647,293 | 3/1972 | Queener | 355/15 |
| 4,017,170 | 4/1977 | Komori et al. | 355/14 R X |
| 4,297,029 | 10/1981 | Carlson | 355/14 R X |

*Primary Examiner*—A. C. Prescott

*Attorney, Agent, or Firm*—Beveridge, Degrandi & Weilacher

[57] ABSTRACT

An electrostatic copying apparatus includes a paper jam detector for producing a jamming signal in response to detection of a paper jam, an emergency stopping device for stopping the copying process in response to the paper jamming signal, and a manually operable release switch for actuation after the paper jam has been cleared to release the stopping action of the emergency stopping means. A preparatory driving device, responsive to the releasing of the stopping action of the emergency stopping device by the operation of the release switch, energizes the main motor of the copying apparatus to move the photosensitive member of the apparatus through at least one rotation. A cleaning device, also responsive to releasing of the stopping action of the emergency stopping device by the operation of the release switch, cleans the photosensitive member during that rotation to assure that the photosensitive member is clean after the jam is cleared and before the next copying cycle.

4 Claims, 27 Drawing Figures

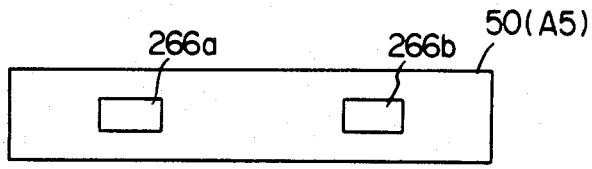
FIG. 14-A
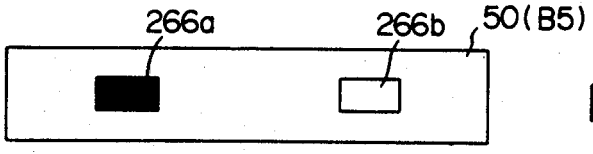
FIG. 14-B
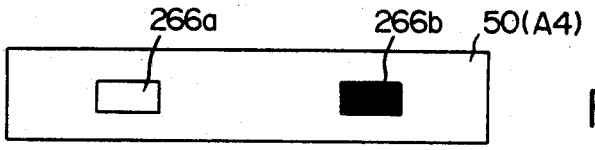
FIG. 14-C
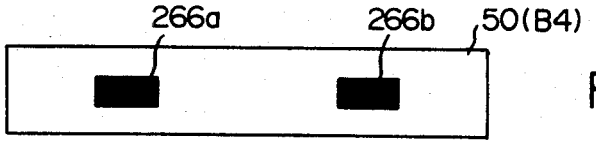
FIG. 14-D
FIG. 15
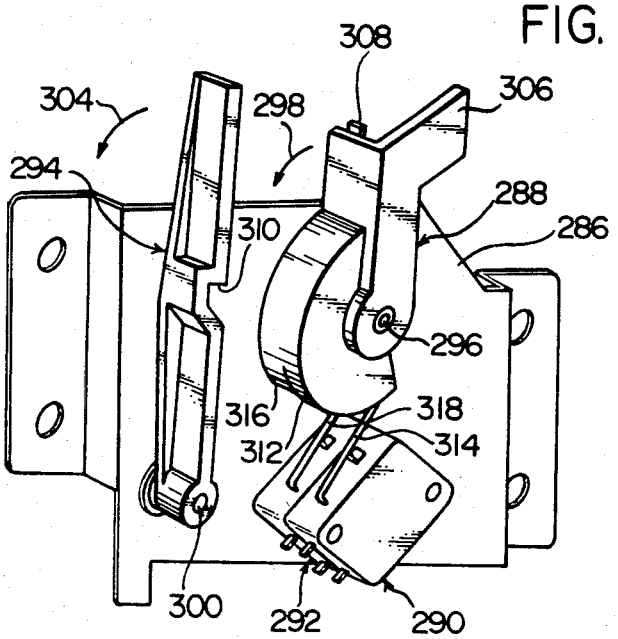

FIG. 16-A
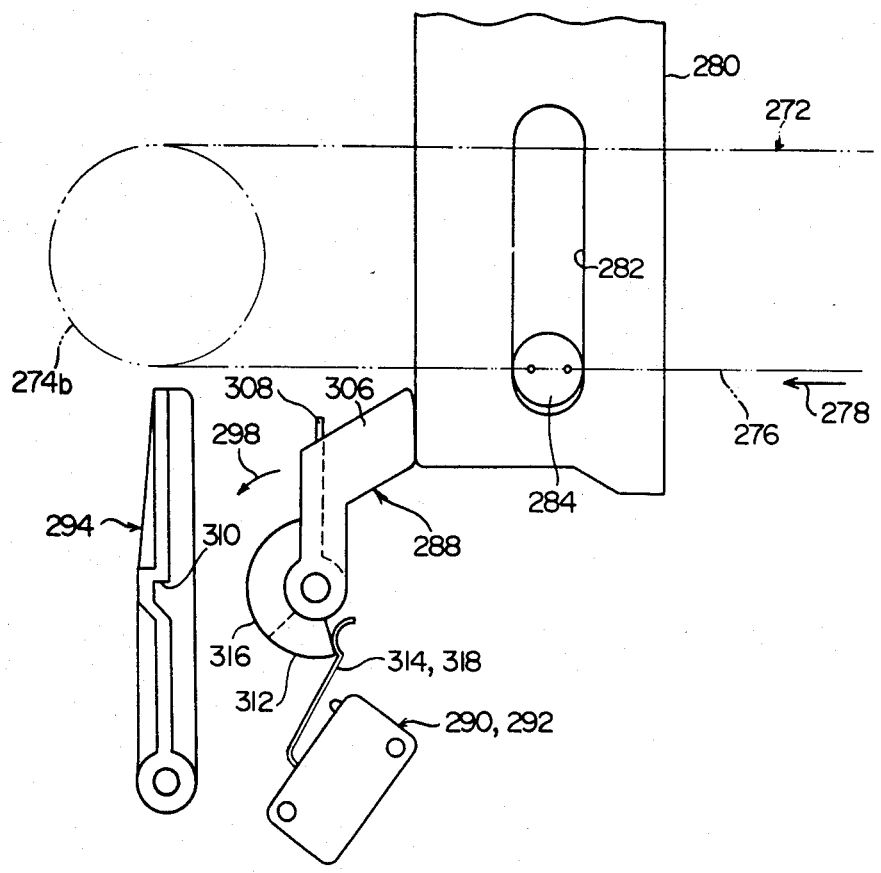

FIG. 16-B
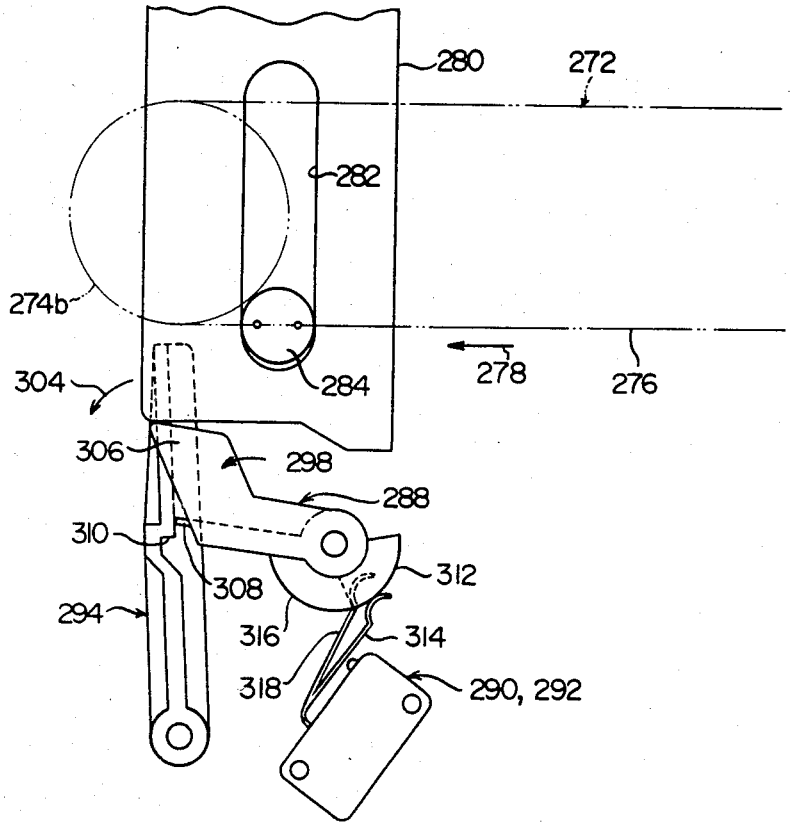

FIG. 16-C
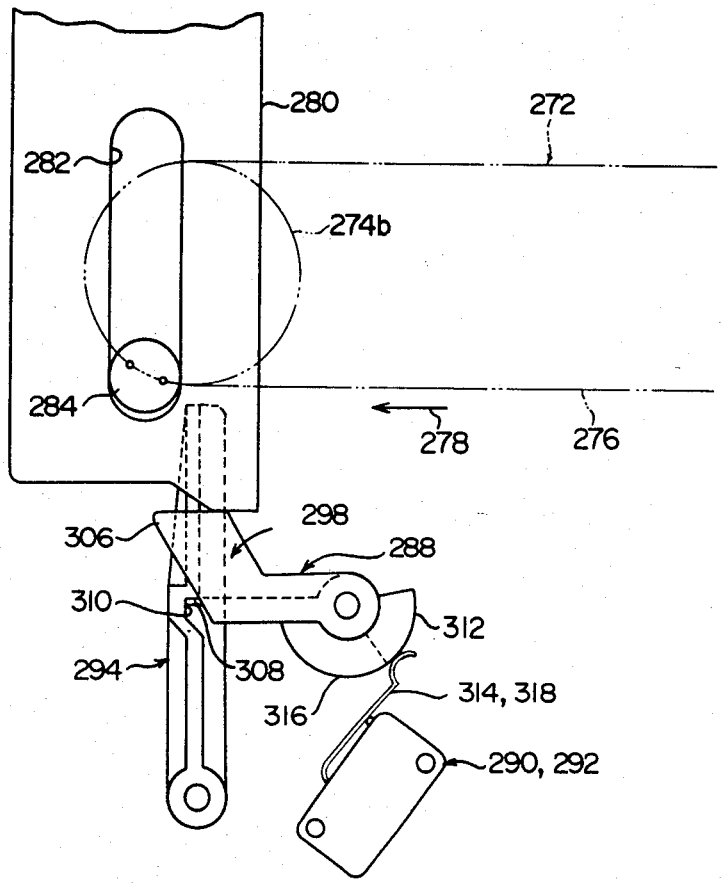

FIG. 16-D
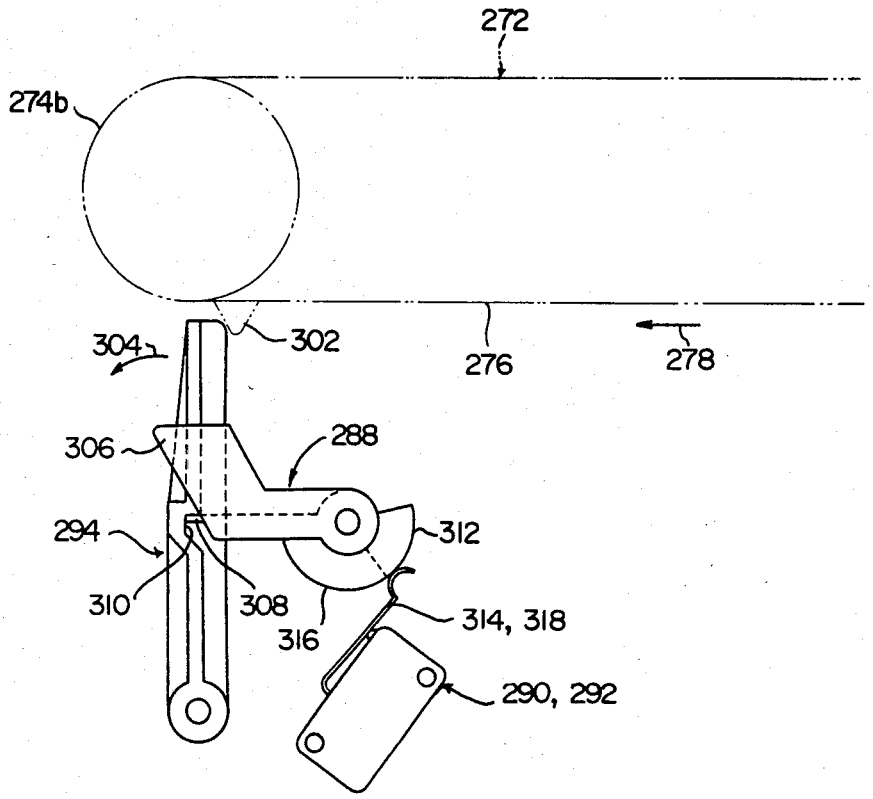

ELECTROSTATIC COPYING APPARATUS

This is a division of application Ser. No. 250,829, filed Apr. 3, 1981 now abandoned.

BACKGROUND OF THE INVENTION

1. Field of the Invention

This invention relates to an electrostatic copying apparatus and its constituent elements.

2. Description of the Prior Art

Recently, electrostatic copying apparatuses of the visible image-transfer type have gained widespread commercial acceptance. This type of electrostatic copying apparatus performs a copying process which comprises forming on a photosensitive member a latent electrostatic image corresponding to the image of an original document to be copied, applying toner particles to the latent image to develop it to a visible image, and transferring the visible image to a receptor sheet. The apparatus is provided with a photosensitive member which is disposed on the surface of a rotary drum or an endless belt-like member mounted within a housing and is adapted to be moved through a predetermined endless moving path (i.e., a circular or otherwise-shaped endless moving path defined by the surface of the rotary drum or endless belt-like member) according to the movement of the rotary drum or endless belt-like material, and along the moving path of the photosensitive member are located a latent electrostatic image-forming zone, a developing zone and a transfer zone in this order in the moving direction of the photosensitive member. In the latent electrostatic image-forming zone, corona discharge is generally applied to the surface of the photosensitive member by a charging corona-discharge device thereby charging the photosensitive member to a specified polarity. Then, by the action of an optical unit, the image of an original document placed on a transparent plate of an original-support mechanism disposed on the top surface of the housing is projected onto the photosensitive member. Consequently, the charge on the photosensitive member is selectively caused to disappear, and a latent electrostatic image corresponding to the image of the original document to be copied is formed on it. In the development zone, toner particles are applied to the latent electrostatic image on the photosensitive member by the action of a developing device according to the charge of the latent image, thereby developing the latent image to a visible image (toner image). Then, in the transfer zone, the visible image on the photosensitive member is transferred to a receptor sheet transferred through the transfer zone, thereby forming the visible image corresponding to the image of the original document on the receptor sheet.

In order to form the desired visible image of good quality repeatedly on receptor sheets in the above-mentioned electrostatic copying apparatus of the visible image-transfer type, it is important, as well known to those skilled in the art, that the electric charge and the toner particles remaining on the photosensitive member after the transfer of the visible image in the transfer zone should be fully removed so as to avoid any adverse effects of the residual charge and toner particles on the next copying cycle. Removal of the residual charge is generally effected by exposing the entire surface of the photosensitive member to light by means of a charge-eliminating lamp, and/or by applying corona discharge to the photosensitive member by a charge-eliminating corona discharge device, after the transfer of the visible image in the transfer zone. On the other hand, the removal of the residual toner is accomplished by causing a cleaning means such as a cleaning blade or a magnetic brush mechanism to act on the surface of the photosensitive member after the transfer of the visible image in the transfer zone. When the aforesaid developing device is comprised of a magnetic brush mechanism, the developing device can be caused to function both as developing means and cleaning means.

The disadvantage with the conventional visible image transfer type electrostatic copying apparatus is that because the longitudinal size of a visible image formed on the photosensitive member does not always correspond to that of a receptor sheet, a visible image having a larger longitudinal size than the receptor sheet transferred through the transfer zone is frequently formed on the photosensitive member and makes it difficult to remove the residual charge and toner particles fully from the photosensitive member after the transfer of the visible image in the transfer zone. When the longitudinal size of the visible image formed on the photosensitive member is larger than that of a receptor sheet transferred through the transfer zone, a part of the visible image on the photosensitive member naturally remains on the photosensitive member without being transferred to the receptor sheet after the transfer of the visible image in the transfer zone. The amount of the toner particles remaining on the photosensitive member after the transfer is relatively small in that area of the visible image on the photosensitive member which has been transferred to the receptor sheet, and therefore, in this area, the residual charge and toner particles on the photosensitive member can be fully removed by the action of the suitable charge-eliminating means and cleaning means of the types mentioned hereinabove. In that area of the visible image on the photosensitive member which remains untransferred to the receptor sheet, however, a relatively large amount of the toner particles remains on the photosensitive member after the transferring operation. In this case, the light irradiated onto the surface of the photosensitive member from a charge-eliminating lamp and/or the corona discharge applied to the surface of the photosensitive member from a charge-eliminating corona discharge device is intercepted by the toner particles remaining in a relatively large amount, and cannot act fully on the surface of the photosensitive member, resulting in insufficient removal of the residual charge. In addition, since the remaining toner particles in this area adhere relatively firmly to the photosensitive member owing to the insufficient removal of the charge as stated above, the remaining toner particles cannot be fully removed by the aforesaid cleaning means.

In a conventional electrostatic copying apparatus of the latent electrostatic image-transfer type which differs from the aforesaid visible image-transfer type copying apparatus in that a latent electrostatic image formed on the photosensitive member is directly transferred to a copying paper without development and is developed to a visible image by application of toner particles, too, the longitudinal size of the latent electrostatic image formed on the photosensitive member does not always correspond to that of the copying paper transferred through the transfer zone, and a latent electrostatic image having a larger longitudinal size than the copying paper transferred through the transfer zone is frequently formed. In such a case, a part of the latent electrostatic image on the photosensitive member remains there without being transferred to the copying paper after the transfer of the latent electrostatic image to the copying paper, and therefore, even after the transfer of the latent electrostatic image in the transfer zone, a relatively large amount of charge remains in some area of the photosensitive member. It is not necessarily easy to remove such a relatively large amount of charge completely.

Furthermore, conventional electrostatic copying apparatus of the visible image-transfer type or the latent electrostatic image-transfer type and their constituent elements have various problems or defects to be solved or removed as will be pointed out in the following detailed description of one embodiment of the electrostatic copying apparatus with reference to the accompanying drawings.

SUMMARY OF THE INVENTION

It is a primary object of this invention to provide an improved electrostatic copying apparatus in which an electric charge and/or toner particles remaining on a photosensitive member after the transferring of a visible image or a latent electrostatic image in a transfer zone are always fully removed exactly and easily and therefore the desired visible image of good quality can be repeatedly formed on copying papers.

Extensive investigations of the present inventors have led to the discovery that when a corona discharge device for charging a photosensitive member to a specified polarity in a latent electrostatic image-forming area is controlled so as to be operated only for a time period corresponding to the longitudinal size of a copying paper transferred through a transfer zone, thereby making the longitudinal size of a latent electrostatic image formed on the photosensitive member or a developed image obtained by developing the latent image substantially equal to, or smaller than, the longitudinal size of a copying paper transferred through a transfer zone, relatively large amounts of electric charge and/or toner particles are prevented from remaining on the photosensitive member without being transferred to the copying paper after the transfer of the visible image or latent image, and therefore that the charge and/or toner particles remaining on the photosensitive member after the transfer can be fully removed exactly and easily.

In order to achieve the primary object, the present invention provides an electrostatic copying apparatus comprising a housing, a photosensitive member disposed within the housing for free movement through an endless moving path defined within the housing, an original-support mechanism disposed on the top surface of the housing and including a transparent plate on which to place an original document to be copied, a charging corona-discharge device for applying corona discharge to the photosensitive member in a latent electrostatic image-forming zone located along the moving path of the photosensitive member, an optical unit for projecting the image of the original document placed on the transparent plate onto the photosensitive member in the latent electrostatic image-forming zone, and a paper transfer unit for transferring a copying paper through a predetermined transfer passage extending through a transfer zone located along the moving path of the photosensitive member and downstream of the latent electrostatic image-forming zone in the moving direction of the photosensitive member; characterized in that the apparatus further includes a detecting means for detecting the longitudinal size of the copying paper being transferred by the transfer unit and a control means for operating the corona discharge device only for a period of time corresponding to the detected longitudinal size of the copying paper.

Another object of this invention is to solve or remove the various problems or defects of conventional electrostatic copying apparatuses and their constituent elements as apparent from the following description. Thus, the present invention also provides an electrostatic copying apparatus and its constituent elements which are free from such problems or defects.

BRIEF DESCRIPTION OF THE DRAWINGS

FIGS. 14-A to 14-D are diagrammatic views schematically showing a paper cassette size displaying means provided in various copying paper cassettes applied to the electrostatic copying apparatus shown in FIGS. 1 and 2;

FIG. 15 is a perspective view showing a detecting switch mechanism used in the electrostatic copying apparatus shown in FIGS. 1 and 2;

FIGS. 16-A to 16-D are simplified views showing the operation of a detecting switch mechanism used in FIGS. 1 and 2;

DETAILED DESCRIPTION OF THE PREFERRED EMBODIMENTS

An electrostatic copying apparatus of the visible image-transfer type which is one embodiment of the improved electrostatic copying apparatus in accordance with this invention is described below in detail with reference to the accompanying drawings.

GENERAL CONSTRUCTION

Figure 1:
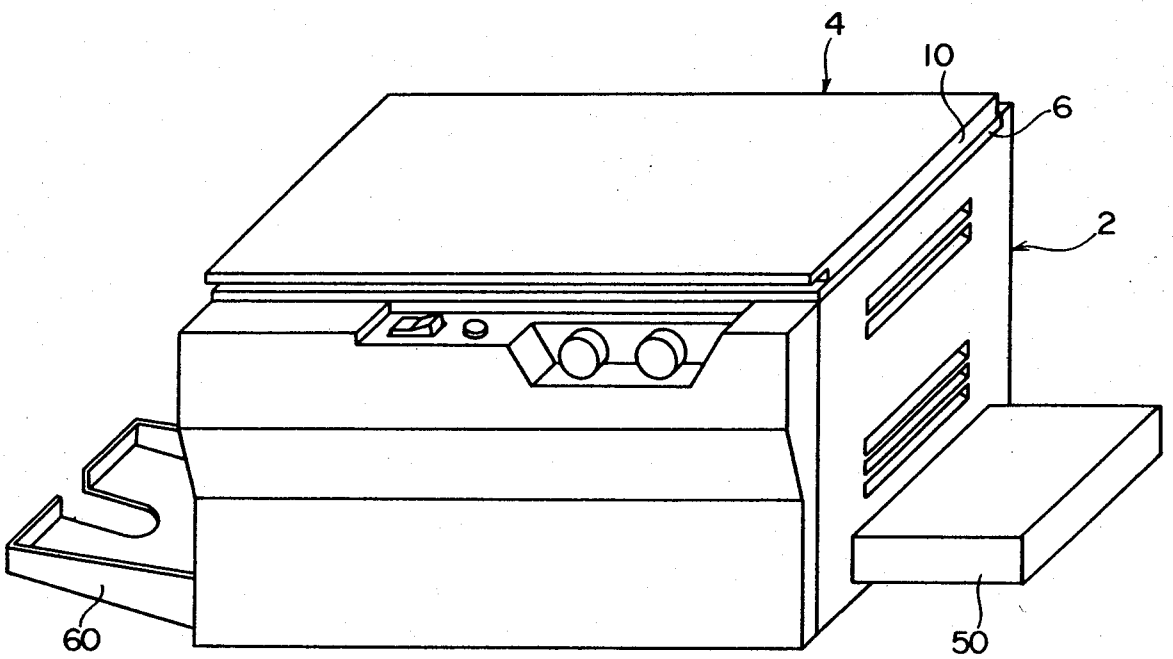
FIG. 1 is a perspective view showing one embodiment of the electrostatic copying apparatus constructed in accordance with this invention.
Figure 2:
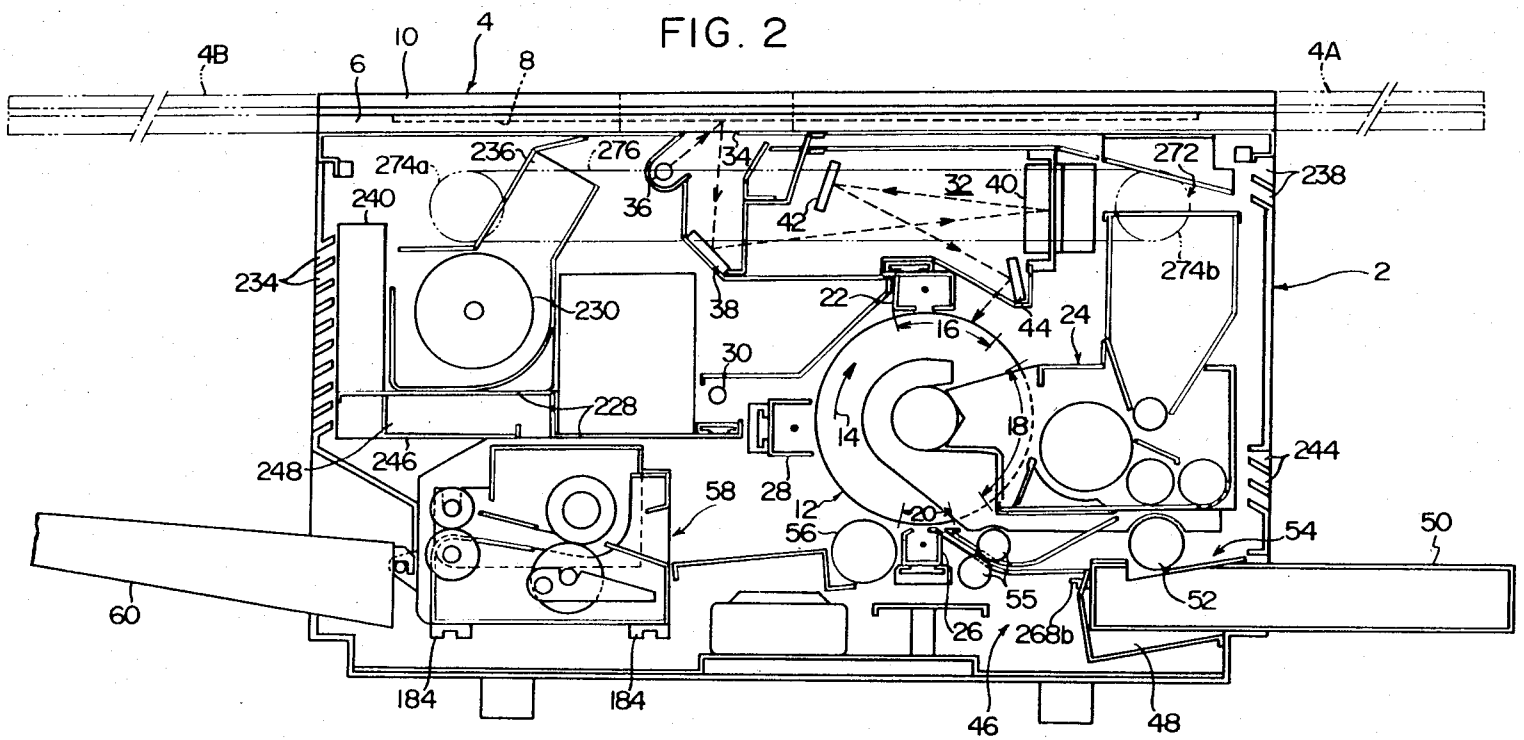
FIG. 2 is a simplified sectional view of the electrostatic copying apparatus shown in FIG. 1.

First of all, the general construction of the illustrated electrostatic copying apparatus is described in outline with reference to FIGS. 1 and 2.

The illustrated electrostatic copying apparatus has a substantially rectangular housing shown generally at 2. On the top surface of the housing 2 is disposed an original-support mechanism 4 for supporting an original document to be copied. The original-support mechanism 4 is constructed of a support frame 6 mounted movably for scanning of the original document by a suitable method (in the left and right directions in FIG. 2), a transparent plate 8 (FIG. 2) fixed to the support frame 6 and adapted to place the original document thereon, and an original-holding member 10 which has one edge portion (the edge portion located in the upper part in FIG. 1) connected pivotably to the support frame 6 and which is to be turned by a manual operation between a closed position at which it covers the transparent plate 8 and the original document placed on it (the position shown in FIGS. 1 and 2) and an open position at which the transparent plate 8 and the original document on it are brought to view. The original-support mechanism 4 is preferably of such a type that when the electrostatic copying apparatus is in an inoperative state, it stops at a stop position shown by a solid line in FIGS. 1 and 2, but when the copying apparatus sets in operation and the copying process is performed, it makes a preparatoy movement from the stop position to a scanning movement starting position shown by a two-dot chain line 4A in FIG. 2 in the right direction, then makes a scanning movement from this start position to a scanning movement-ending position shown by a two-dot chain line 4B in FIG. 2 in the left direction, and thereafter, returns to the stop position in the right direction in FIG. 2. On the upper part of the front surface of the housing 2 are provided operating elements such as a main switch, a knob for setting the number of copies required, and a knob for adjusting the intensity of exposure and display elements such as a display lamp, which are all known per se.

As FIG. 2 shows in a simplified manner, a cylindrical rotary drum 12 is rotatably mounted within the housing 2, and a photosensitive member is disposed on at least a part of the peripheral surface of the rotary drum 12. Accordingly, the photosensitive member is moved by the rotation of the rotary drum 12 through a circular endless moving path defined by the peripheral surface of the rotary drum 12. Instead of the rotary drum 12, an endless belt-like material known well to those skilled in the art may be mounted within the housing 2, and a photosensitive member may be disposed on at least a part of the surface of the endless belt-like member. In this alternative construction, the photosensitive member is moved through an endless moving path defined by the surface of the endless belt-like member.

Along the peripheral surface of the rotary drum 12 rotated in the direction of an arrow 14, therefore along the moving path of the photosensitive member on the rotary drum 12, are disposed a latent electrostatic image-forming zone 16, a developing zone 18 and a transfer zone 20 in this order viewed in the moving direction of the photosensitive member.

In the latent electrostatic image-forming zone 16 is disposed a charging corona-discharge device 22 for applying corona discharge to the surface of the photosensitive member to charge it to a specified polarity. A developing device 24 is provided within the developing zone 18, which function both as a developing means for applying toner particles to a latent electrostatic image formed on the photosensitive member to develop it and as a cleaning means for removing residual toner particles from the photosensitive member after the transfer of a developed image to a copying paper in the transfer zone 20 in the illustrated embodiment. The transfer zone 20 includes therein a transfer corona-discharge device 26 for applying corona discharge to the back surface of the copying paper at the time of transferring a developed image on the photosensitive member to the copying paper.

A charge-eliminating corona-discharge device 28 and a charge-eliminating lamp 30 for removing residual charges on the photosensitive member after the transfer of a developed image on the photosensitive member to a copying paper in the transfer zone 20 are disposed downstream of the transfer zone 20 and upstream of the latent electrostatic image-forming zone 16 viewed in the rotating direction of the rotary drum 12 shown by the arrow 14, and therefore in the moving direction of the photosensitive member. The charge-eliminating corona-discharge device 28 applies corona discharge to the photosensitive member for charge elimination, and the charge-eliminating lamp 30 exposes the entire surface of the photosensitive member to light.

An optical unit 32 for projecting the image of an original document placed on the transparent plate 8 of the original-support mechanism 4 onto the photosensitive member is provided above the rotary drum 12 within the housing 2. The optical unit 32 includes an illuminating lamp 36 for illuminating the original document through an exposure opening 34 formed on the top surface of the housing 2, and a first reflecting mirror 38, an in-mirror lens 40, a second reflecting mirror 42 and a third reflecting mirror 44 for projecting the light reflected from the original document onto the photosensitive member. As shown by a broken arrow in FIG. 2, the optical unit 32 projects the image of the original document placed on the transparent plate 8 onto the photosensitive member at a position immediately downstream of the charging corona-discharge device 22 in the rotating direction of the rotating drum 12 in the latent electrostatic image-forming zone 16. In the illustrated embodiment, the image of the original document is scanned and optically projected on the photosensitive member by moving the original-support mechanism 4 in a scanning manner. Instead of this, the image of the original document can also be scanned and optically projected on the photosensitive member by scanningly moving at least a part of the optical unit.

A paper transfer unit shown generally at 46 is also provided in the illustrated electrostatic copying apparatus. The paper transfer unit 46 includes a paper-feed mechanism 54 consisting of a paper cassette 50 whose end is inserted into a cassette-receiving section 48 within the housing 2 through an opening formed in the right end wall of the housing 2 and a paper feed roller 52 for feeding copying paper sheets one by one from the paper cassette 50 by being rotationally driven while being in engagement with the topmost sheet of a stack of paper sheets in the paper cassette 50 through an opening formed on the top surface of the paper cassette 50. The paper transfer unit 46 also comprises a pair of transfer rollers 55 for transferring the paper sheet delivered by the action of the paper feed roller 52 to the transfer zone 20 and a separator roller 56 for separating the copying paper adhering closely to the surface of the photosensitive member on the rotary drum 12 in the transfer zone 20 from the photosensitive member and carrying it away from the transfer zone 20. The copying paper carried away from the transfer zone 20 moves through a fixing mechanism shown generally at 58 for fixing the developed image on the copying paper and is discharged into a receiver tray 60 from a discharge opening formed in the left end wall of the housing 2. In the illustrated embodiment, the paper transfer unit 46 is of the type provided with the paper feed mechanism 54 utilizing the paper cassette 50. In place of, or in addition to, the paper feed mechanism 54, a paper feed mechanism of the type adapted to unwind a roll of copying paper, cut it to a required length and deliver it may be provided in the paper transfer unit 46.

The operation of the electrostatic copying apparatus described above is described briefly. While the rotary drum 12 is being rotated in the direction of the arrow 14, a latent electrostatic image is formed on the surface of the photosensitive member in the latent electrostatic image-forming zone 16. Specifically, the latent electrostatic image is formed by applying corona discharge to the photosensitive member by means of the charging corona-discharge device 22 to charge it to a specified polarity, and then projecting the image of an original document placed on the transparent plate 8 onto the charged photosensitive member by means of the optical unit 32. In projecting the image of the original document onto the photosensitive member by the optical unit 32, the original-support mechanism 4 is caused to make a scanning movement from the scanning movement starting position shown by the two-dot chain line 4A to the scanning movement ending position shown by the two-dot chain line 4B in the left direction in FIG. 2. Then, in the developing zone 18, toner particles are applied to the latent electrostatic image on the photosensitive member by the action of the developing device 24 thereby developing the latent electrostatic image on the photosensitive member. In the meantime, the paper transfer unit 46 transfers a copying paper to the transfer zone 20 in synchronism with the rotation of the rotary drum 12, and in the transfer zone 20, the developed image on the photosensitive member is transferred to the copying paper. The copying paper having the developed image transferred thereto is fixed by the fixing mechanism 58 and then discharged into the receiver tray 60. On the other hand, the rotary drum 12 continues to rotate through at least one turn, preferably through two or more turns, after the developed image on the photosensitive member has been transferred to the copying paper, and during this period, the residual charge on the photosensitive member is removed by the action of the charge-eliminating corona-discharge device 28 and the charge-eliminating lamp 30. Furthermore, by the functioning of the developing device 24 as a cleaning means, the residual toner on the photosensitive member is removed.

The individual constituent elements of the electrostatic copying apparatus are described below in detail.

METHOD OF MOUNTING THE ROTARY DRUM

Figure 3:
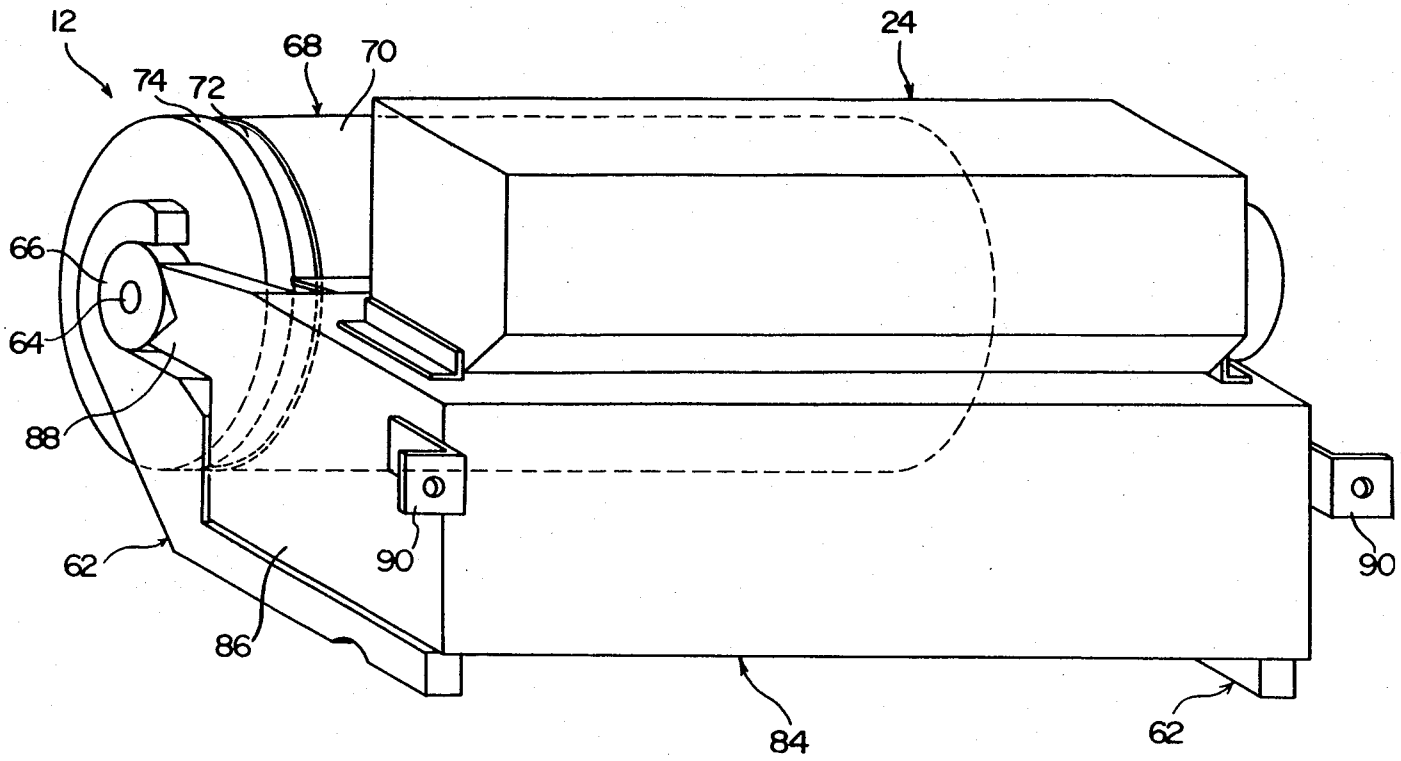
FIG. 3 is a perspective view showing the method of mounting a rotary drum and a developing device in the electrostatic copying apparatus shown in FIGS. 1 and 2.
Figure 4:
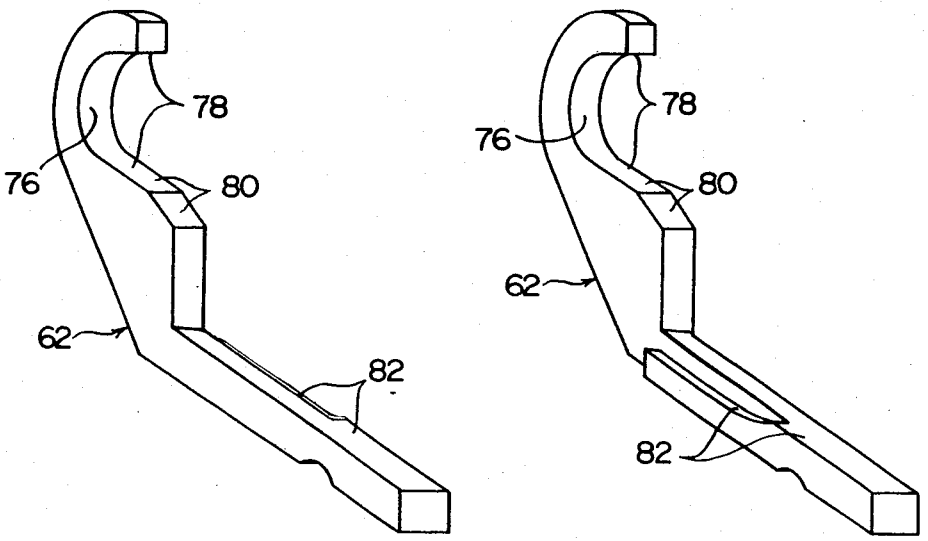
FIG. 4 is a perspective view of a pair of support and guide members used in the mounting of the rotary drum and the developing device in the electrostatic copying apparatus shown in FIGS. 1 and 2.

The method of mounting the rotary drum 12 is described mainly with reference to FIGS. 3 and 4.

In the illustrated embodiment, a pair of guide and support members 62 are provided within the housing 2 (see FIGS. 1 and 2) which are spaced from each other at a fixed distance in the direction of the central axis of rotation of the rotary drum 12 (i.e., in the direction perpendicular to the sheet surface in FIG. 2), and the rotary drum 12 is rotatably mounted by utilizing the guide and support members 62.

Before describing the detailed construction of the guide and support members 62, the construction of the rotary drum 12 itself will be touched upon. The illustrated rotary drum 12 is constructed of a shaft 64, bearing members 66 (only one of them is shown in FIG. 3) having a relatively small diameter and a circular peripheral surface which are provided at the two opposite end portions of the shaft 64, and a drum member 68 fixed to the shaft 64 between the bearing members 66. A photosensitive member 70 made of a suitable material is disposed on the main surface portion of the drum member 68. It is convenient that an annular groove 72 having a slightly smaller diameter than the outside diameter of the photosensitive member 70 is formed at the outside portion of at least one side edge of the photosensitive member 70 on the drum member 68, and a non-photosensitive area 74 (an area where the photosensitive member does not exist) is formed at both end portions of the drum member 68. The tip of a peeling member (not shown) known to those skilled in the art for accurately peeling a copying paper in contact with the surface of the photosensitive member 70 in the transfer zone 20 (at least one side edge portion of this copying paper is located in a mating position with respect to the annular groove 72) from the surface of the photosensitive member 70 after the developed image has been transferred to the copying paper.

Each of the guide and support members 62 has a shaft support opening 76 for receiving each of the bearing members 66 located at the opposite end portions of the rotary drum 12. It is important that the shaft support opening 76 should have a recess 78 opened in a suitable direction (in the illustrated embodiment, in a right-hand side, substantially horizontal direction in FIG. 2) substantially perpendicular to the central axis of rotation of the rotary drum 12. Furthermore, it is important that each of the guide and support members 62 has provided therein a main guide surface 80 which extends from the lower end of the recess 78 in a direction substantially perpendicular to the central axis of rotation of the rotary drum 12 and when mounting the rotary drum 12, guides the peripheral surface of the bearing member 66. In the illustrated embodiment, the main guide surface 80 is defined by the top surface of the piece forming the guide and support member 62, and extends from the lower end of the recess 78 substantially horizontally and then inclines slightly downwardly. Preferably, each of the guide and support members 62 has provided therein an initial guide surface 82 which extends inwardly of the main guide surface 80 in a direction substantially perpendicular to the central axis of rotation of the rotary drum 12 and when mounting the rotary drum 12, guides the non-photosensitive area 74 at each side end portion of the drum member 68 prior to the guiding of the peripheral surface of the bearing member 66 by the main guide surface 80. In the illustrated embodiment, the initial guide surface 82 extends nearly horizontally inwardly and downwardly of the main guide surface 80.

The rotary drum 12 is to be mounted on the guide and support members 62 in the following manner. With reference to FIG. 2 as well as FIGS. 3 and 4, it is necessary that in mounting the rotary drum 12, the developing device 24 and the right end wall of the housing 2 should not be mounted in position but detached therefrom. In this condition, the rotary drum 12 is inserted into the housing 2 through an opening which is to be later closed by the right end wall, i.e. the right end opening of the housing 2, and the non-photosensitive areas 74 at the opposite end portions of the rotary drum 12 are placed respectively on the end portions of the initial guide surfaces 82 of the guide and support members 62. Then, the rotary drum 12 is moved along the initial guide surfaces 82 toward the shaft support openings 76 of the rotary drum 12 (namely, to the left in FIG. 2). In other words, the rotary drum 12 is revolved over the initial guide surfaces 82 toward the shaft support openings 76. When the rotary drum 12 has been moved by a predetermined amount along the initial guide surfaces 82, the bearing members 66 on the opposite end portions of the rotary drum 12 respectively reach the main guide surfaces 80 of the guide and support members 62. Then, when the rotary drum 12 is further moved toward the shaft support openings 76 along the main guide surfaces 80 so that the bearing members 66 roll over the guide surfaces 80, the non-photosensitive areas 74 of the rotary drum depart from the initial guide surfaces 82, and the bearing members 66 are received in the shaft support openings 76 through the recesses 78. Thus, the rotary drum 12 is rotatably and detachably fitted into the shaft support openings 76 through the bearing members 66 disposed on its opposite end portions.

Detachment of the rotary drum 12 from the shaft support openings 76 can be accurately prevented by mounting the developing device 24 in position within the housing 2 following the mounting of the rotary drum 12. The construction of the developing device 24 itself will be described later on. The developing device 24 has a frame generally shown at 84, and it is important that both side plates 86 of the frame (only one of them is shown in FIG. 3) should be positioned face to face with the bearing members 66 disposed on the opposite end portions of the rotary drum 12 and should also have protruding pieces 88 protruding toward the bearing members 66. The developing device 24 having the frame 84 described above is positioned in place by placing the lower ends of its both side portions on the initial guide surfaces 82 of the guide and support members 62 and then moving them toward the rotary drum 12 thereby pushing the protruding pieces 89 against the peripheral surfaces of the bearing members 66 of the rotary drum 12. After it has been positioned in place, it is fixed at the position by, for example, fixing connecting pieces 90 secured to the rear sides of the both side portions of the frame 84 to suitable members within the housing 2, for example upstanding walls (not shown) disposed within the housing 2. Thus, in the state in which the developing device 24 has been fixed in place, the protruding pieces 88 come into engagement with the bearing members 66 of the rotary drum to restrain the bearing members 66 within the shaft support openings 76 of the guide and support members 62, thereby keeping the rotary drum 12 exactly in position. In addition, the apparatus is constructed such that when the protruding pieces 88 come into engagement with the bearing members 66, the distance between a cylindrical rotary sleeve provided in the frame 84 of the developing device 24 and the peripheral surface of the rotary drum 12 (i.e., the surface of the photosensitive member 70) can be set as required. As is well known to those skilled in the art, to achieve good development as desired, it is important to set this distance as required.

The method of mounting the rotary drum 12 as described above is basically the same as that described in the specification and drawings of the Applicants' copending Japanese Patent Application No. 40302/1979 (entitled ELECTROSTATIC COPYING APPARATUS filed Apr. 5, 1979), but differs in the following respects from one specific embodiment disclosed in the abovementioned specification and drawings. According to the specific embodiment disclosed in the specification and drawings of the above-cited prior application, spacer rings rotatably and coaxially disposed at both end portions of the cylindricaly rotary sleeve of the developing device are caused to abut the non-photosensitive areas at both end portions of the drum member of the rotary drum, thereby holding the rotary drum in position and setting the distance between the peripheral surface of the rotary drum (i.e., the surface of the photosensitive member and the rotary sleeve as required. It is necessary in this case to make precisely to required sizes the spacer rings which come into engagement with the drum member rotationally driven and are therefore rotated according to the rotation of the drum member. It is comparatively difficult however to make such spacer rings precisely to required sizes, and expensive machining is required.

In contrast, in the construction shown in FIGS. 3 and 4, the rotary drum 12 is held in position, and also the distance between the rotary sleeve and the peripheral surface of the rotary drum 12 (therefore, the surface of the photosensitive member) is set as required, by bringing the protruding pieces 88 provided in the frame 84 which are stationary parts of the developing device 24 into engagement with the peripheral surfaces of the bearing members 66 which are stationary parts of the rotary drum 12. It will be readily appreciated that working of the frame 84 and the protruding pieces 88 which are the stationary parts of the developing device 24 precisely to required sizes is easier and less costly than working of the rotatable spacer rings precisely to required sizes. Accordingly, the construction illustrated in FIGS. 3 and 4 can lead to reduced costs of production as compared with the specific embodiment disclosed in the specification and drawings of the above-cited Japanese Patent Application.

DEVELOPING DEVICE

Now, the developing device 24 is described with reference to FIGS. 5 to 8.

Figure 5:
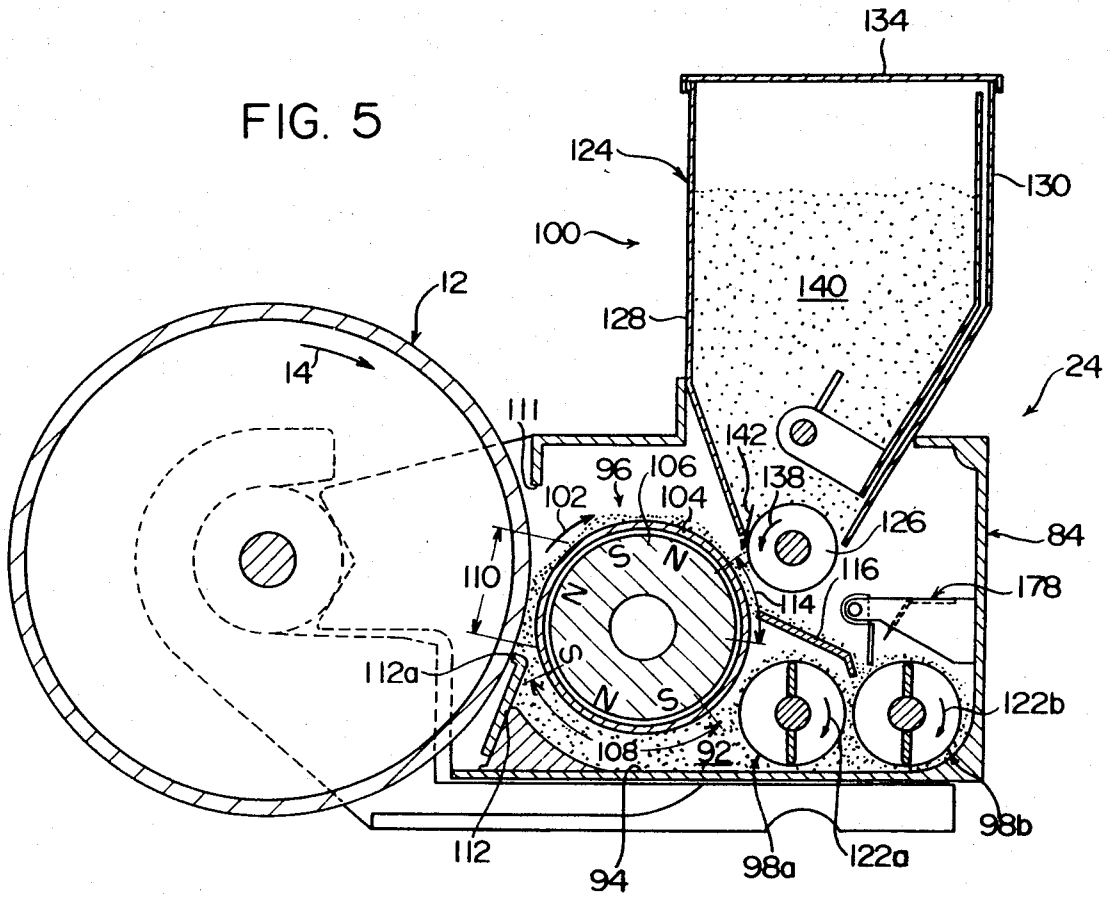
FIG. 5 is a sectional view showing the developing device used in the electrostatic copying apparatus shown in FIGS. 1 and 2.
Figure 6:
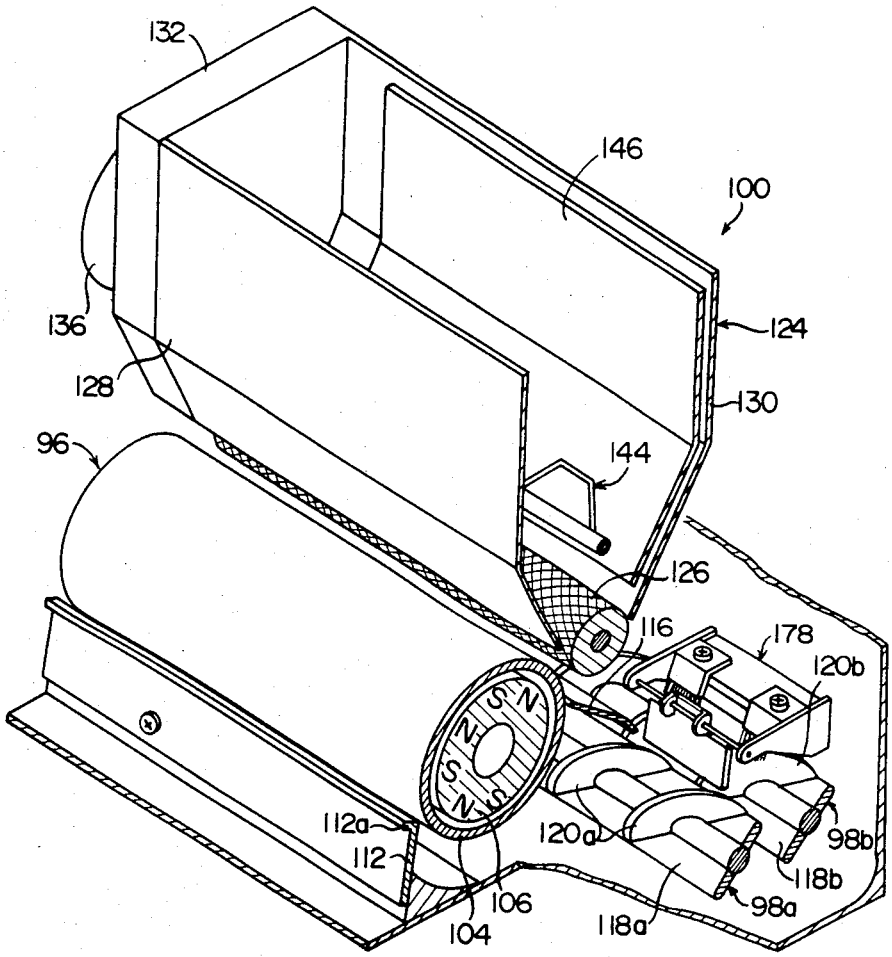
FIG. 6 is a perspective view, partly broken away, of the developing device used in the electrostatic copying apparatus shown in FIGS. 1 and 2.

Referring to FIGS. 5 and 6, the developing device 24 is provided with the frame 84 described hereinabove. As can be easily understood from FIG. 5, the lower part of the frame 84 constitutes a developer receptacle 94 containing a developer 92 which in the illustrated embodiment is a two-component developer composed of carrier particles and toner particles. Within the frame 84 of the developing device 24 are disposed a developer applicator mechanism 96 and rotating and stirring mechanism 98*a* and 98*b*. A toner particle dispenser generally shown at 100 is mounted to an opening portion formed on the top surface of the frame 84.

The developer applicator mechanism 96 consists of a cylindrical rotary sleeve member 104 to be rotationally driven in the direction shown by arrow 102 (FIG. 5) and a roll-like stationary permanent magnet 106 disposed within the rotary sleeve member 104. The developer applicator mechanism 96 magnetically holds a part of the developer 92 in the receptacle 94 on the surface of the rotary sleeve member 104 in a developer take-up area 108 by the action of a magnetic field generated by the stationary permanent magnet 106 and carries the developer 92 so held to a developing operation area 110 within the developing zone 18 (FIG. 2) by the rotation of the rotary sleeve member 104. In the developing operation area 110, the developer 92 held on the surface of the rotary sleeve member 104 is brought into contact with the photosensitive member 70 (FIG. 3) on the rotary drum 12 being rotated in the direction of arrow 14 through an opening 111 formed in the front surface (i.e., that surface which faces the surface of the rotary drum 12) of the frame 84. Thus, the toner particles in the developer 92 are applied to the photosensitive member 70 to develop a latent electrostatic image formed on the photosensitive member 70 to a visible image (toner image) (when the developer device 24 performs a developing action). Or when the developing device 24 performs a cleaning action, the toner particles remaining on the photosensitive member 70 are removed from it and held on the rotary sleeve member 104 by the brushing action of the developer 92 held on the surface of the rotary sleeve member 104 against the photosensitive member 70 and by the magnetic attracting action of a magnetic filed generated by the stationary permanent magnet 106.

Between the developer take-up area 108 and the developing operation area 110 is disposed a brush length-setting member 112 for adjusting the amount of the developer 92, or the thickness of the layer of the developer 92, carried to the developing operation area 110 by the surface of the rotary sleeve member 104 to a suitable value. The tip portion of the brush length-setting member 112 is positioned a predetermined distance from the surface of the rotary sleeve member 104. The brush length-setting member 112 has an extension 112*a* which is curved so as to extend toward the surface of the rotary drum 12 and of which free end is located in proximity to the surface of the rotary drum 12. The extension 112*a* prevents the developer 92, especially the toner particles in it, from scattering through a space between the frame 84 and the surface of the rotary drum 12.

Upstream of the developing operation area 110 viewed in the rotating direction of the rotary sleeve member 104, i.e. in the direction of an arrow 102, a scraping area 114 exists in which the developer 92 is scraped off from the surface of the rotary sleeve member 104. Because the stationary permanent magnet 106 is not magnetized at that part which corresponds to the scraping area 114, there is little or no magnetic field generated by the magnet 106 in the scraping area 114. Within the scraping area 114 is provided a scraping member 116 which contacts or approaches the surface of the rotary sleeve member 104 at its end. The developer 92 held on the surface of the rotary sleeve member 104 is scraped off from the surface of the rotary sleeve member 104 in the scraping area 114 by the action of the end of the scraping member 116 on the developer 92 on the surface of the sleeve member 104. This scraping action is also assisted by the fact that there is little or no magnetic field generated in the scraping area 114. The scraped developer 92 flows down along the scraping member 116 and falls toward the stirring mechanism 98*b*.

Each of the stirring mechanisms 98*a* and 98*b* is formed of a stirring vane member having a plate-like main vane 118*a* or 118*b* and a plurality of semi-helical auxiliary vanes 120*a* or 120*b* provided on both sides of the main vane 118*a* or 118*b*. Preferably, the auxiliary vanes 120*a* of the stirring mechanism 98*a* are arranged alternately with the auxiliary vanes 120*b* of the stirring mechanism 98*b* so that the action of the stirring mechanism 98*a* and the action of the stirring mechanism 98*b* are supplemented each other. The stirring mechanisms 98*a* and 98*b* described above are rotated in the directions of arrows 122*a* and 122*b* respectively in FIG. 5, whereby they stir up the developer 92 separated from the surface of the sleeve member 104 in the scraping area 114 and the toner particles supplied to the developer receptacle 94 from the toner particle dispenser 100 in mixture with the developer 92 present at the bottom portion of the receptacle 94 to mix the carrier particles and the toner particles in the developer 92 uniformly and charge the toner particles triboelectrically.

The toner particle dispenser 100 is comprised of a toner particle receptacle 124 and a dispenser roller 126. The receptacle 124 is defined by a front side wall 128, a rear side wall 130 and both end walls 132 (see FIG. 7 also) and has a toner particle replenishing opening adapted to be closed by a detachable closure member 134 at its top portion, and a toner particle discharging opening at its bottom. The dispenser roller 126 having a plurality of grooves or depressions formed on its surface by knurling, etc. is disposed rotatably at the toner particle discharge opening, and is rotationally driven in the direction of an arrow 138 by an electric motor 136 mounted on one end wall of the receptacle 124. When the dispenser roller 126 is rotated in the direction of the arrow 138, the toner particles 140 in the receptacle 124 are discharged as shown by an arrow 142 and dispensed to the developer receptacle 94. As described in detail hereinbelow, the dispenser roller 126 is rotationally driven only for a required period of time during the performance of the copying process. Hence, the toner particle dispenser 100 dispenses a required amount of the toner particles 140 to the developer receptacle 94 every time the copying process is performed.

In the toner particle dispenser 100 having the aforesaid construction, the toner particles 140 in the receptacle 124 may become a bridge-like agglomerated mass riding between the front side wall 128 and the rear side wall 130 (so-called bridge phenomenon) and/or become an agglomerated mass above the dispenser roller 126. This tends to cause a so-called toner particle clogging phenomenon whereby the toner particles cannot be dispensed as required to the developer receptacle 94 from the receptacle 124 even when the dispenser roller 126 is rotationally driven. In order to prevent such a toner particle clogging phenomenon exactly, both a known rotary toner stirring member 144 and a reciprocable slide plate 146 are provided within the receptacle 124 in the toner dispenser 100.

Figure 7:
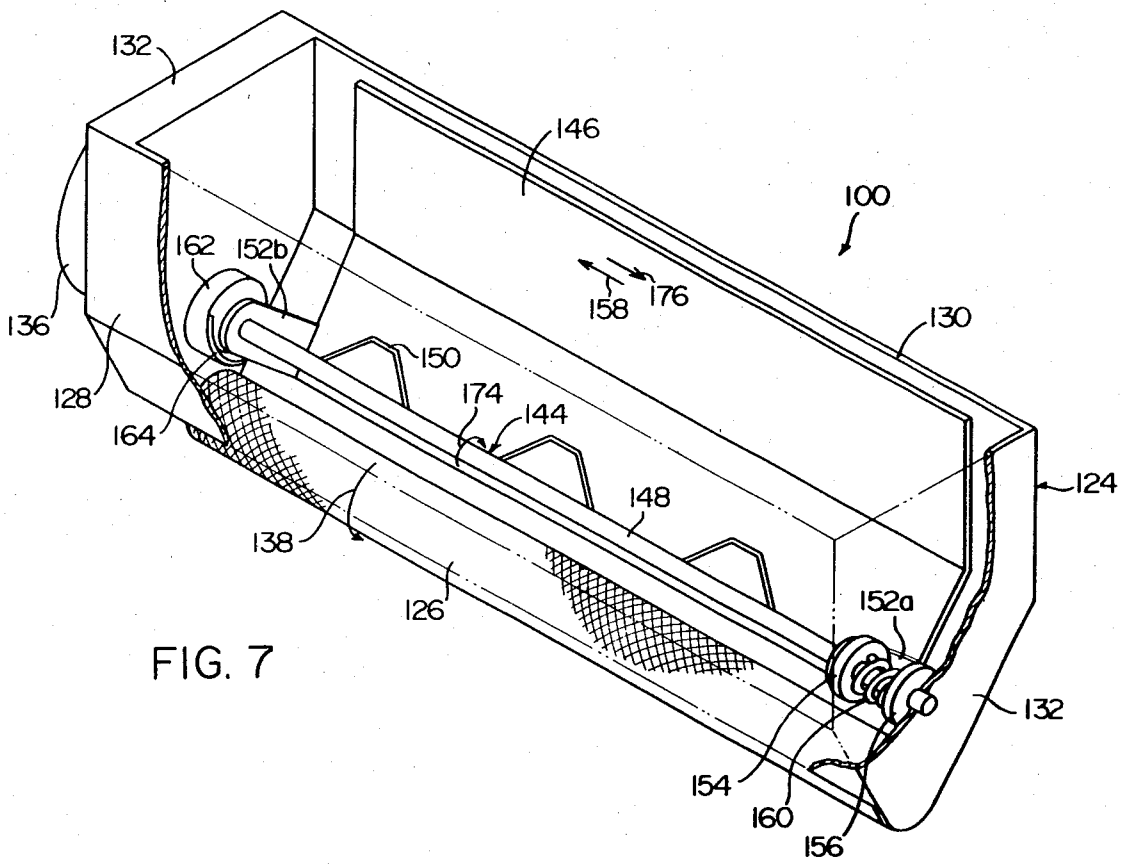
FIG. 7 is a perspective view, partly broken away, of a toner particle dispensing mechanism in the developing device shown in FIGS. 5 and 6.
Figure 8:
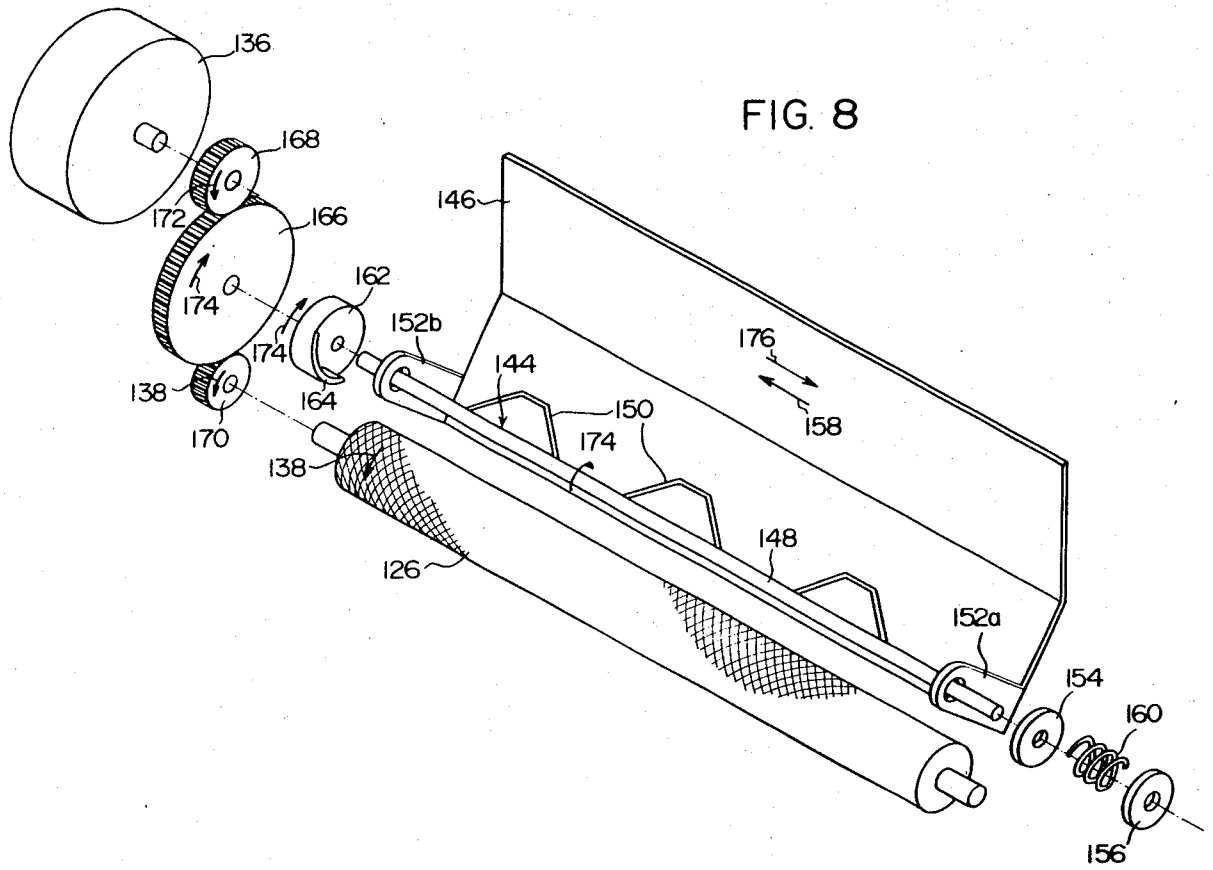
FIG. 8 is an exploded perspective view showing some of the constituent elements of the toner particle dispensing mechanism in the developing device shown in FIGS. 5 and 6.

Referring to FIGS. 7 and 8 in conjunction with FIGS. 5 and 6, the toner stirring member 144 consisting of a shaft 148 extending above, and substantially parallel to, the dispenser roller 126 and stirrers 150 fixed to the shaft 148 in spaced-apart relationship in the axial direction of the shaft 148 is rotatably mounted between the two end walls 132 of the receptacle 124. In addition, the slide plate 146 is disposed along the inside surface of at least one of the front side wall 128 and the rear side wall 130 (the rear side wall 130 in the illustrated embodiment) of the receptacle 124. At both end edges of the slide plate 146 disposed along at least the lower portion of the inside surface of the rear side wall 130, preferably along nearly the entire inside surface thereof, are provided coupling projections 152*a* and 152*b*, and holes formed in the coupling projections 152*a* and 152*b* are idly fitted over the shaft 148. Thus, the slide plate 146 is supported on the shaft 148 such that it can be moved freely in the axial direction of the shaft 148. An annular receiver plate 154 to be abutted against the outside surface of the coupling projection 152*a* is idly secured to one end portion of the shaft 148, and an annular receiver plate 156 is fixed to the shaft 148 outwardly of the annular receiver plate 154. Between the annular receiver plates 154 and 156 is interposed a spring 160 for elastically biasing the slide plate 146 in the direction of an arrow 158 with respect to the shaft 148. At the other end portion of the shaft 148, a cam member 162 located outwardly of the coupling projection 152*b* is fixed to the shaft 148. The cam member 162 has a cam surface 164 acting on the outside surface of the coupling projection 152*b*. Furthermore, the other end portion of the shaft 148 projects through the end wall 132 of the receptacle 124 and a gear 166 is fixed to the projecting end. The gear 166 is engaged with a gear 168 fixed to the output shaft of the electric motor 136 and also with a gear 170 fixedly secured to one end of the supporting shaft for the dispenser roller 126.

In the above-mentioned construction, the output shaft of the electric motor 136 is rotated in the direction of an arrow 172 in FIG. 8 to rotate the dispenser roller 126 in the direction of an arrow 138 and simultaneously to rotate the toner stirring member 144 in the direction of an arrow 174. On the other hand, when the toner stirring member 144 is rotated in the direction of an arrow 174, the cam member 162 fixed to the shaft 148 is rotated accompanyingly in the direction of an arrow 174. Rotation of the cam member 162 in the direction of arrow 174 causes the cam surface 164 to act on the coupling projection 152*b*, thereby moving the slide plate 1 146 in the direction of an arrow 176 against the elastic biasing action of the spring 160. When the cam member 162 further rotates and its cam surface 164 moves away from the coupling projection 152*b*, the slide plate 146 is moved rapidly in the direction of an arrow 158 by the elastic biasing action of the spring 160. Thus, the slide plate 146 is reciprocated in the directions of arrows 158 and 176 as the toner stirring member 144 rotates.

In the toner dispenser 100 provided with the toner stirring member 144 and the sliding plate 146, the action of the rotating toner stirring member 144 prevents the toner particles 140 from becoming an agglomerated mass above the dispenser roller 126 and the action of the reciprocating slide plate 146 exactly prevents the toner particles 140 from becoming a bridge-like agglomerated mass between the front side wall 128 and the rear side wall 130 of the receptacle 124. Hence, the toner particle clogging phenomenon can be accurately prevented. In order to make the action of the slide plate 146 on the toner particle 140 more effective, a suitable projecting piece may, if desired, be attached to the inside surface of the slide plate 146.

As shown in FIGS. 5 and 6, it is convenient to provide a switch mechanism 178 for detecting the amount of the developer 92 in the developer receptacle 94 within the frame 84 of the developing device 24. The switch mechanism 178 is electrically connected to an electrical control circuit (not shown) which constitutes a developer detecting means for producing a signal of prohibiting supplying of toner particles when a sufficient amount of the developer 92 is present in the developer receptacle 94 and a toner supply hampering means which hampers the starting of the rotation of the dispenser roller 126 (therefore, the starting of the operation of the electric motor 136) while the aforesaid signal of prohibiting supplying of toner particles is being produced. The construction of the switch mechanism 178 itself and the construction of the electrical control circuit connected thereto may be the same as those described in detail in the specification and drawings of the Applicants' co-pending Japanese Patent Application No. 22699/1980 (entitled DEVELOPING DEVICE IN ELECTROSTATIC COPYING APPARATUS filed Feb. 17, 1980), and for details of these constructions, reference may be had to the specification and drawings of the above-cited Japanese Patent Application No. 22699/1980.

FIXING MECHANISM

The construction of the fixing mechanism 58 is described in detail with reference to FIGS. 9 and 10 in conjunction with FIG. 2.

The fixing mechanism shown generally at 58 has a lower frame 180 and an upper frame 182. The lower frame 180 is slidably mounted on a pair of support rails 184 (FIG. 2) extending in a direction perpendicular to the sheet surface in FIG. 2. The upper frame 182, on the other hand, is mounted for pivoting with respect to a shaft 188 extending between the two end walls 186 of the lower frame 180, and therefore with respect to the lower frame 180. In a normal condition, the upper frame 182 is at an operating position at which one side edge portion 192 of its top surface wall 190 abuts a receiver piece 194 extending inwardly from the top end portions of the two end walls 186 of the lower frame 180, i.e. the operating position shown by a solid line in FIGS. 9 and 10, and is held at the operating position by means of a setscrew 196 which extends through the one side edge portion 192 and is threadably fitted with the receiver piece 194.

Between two end walls 198 of the upper frame 182 is rotatably mounted a hollow cylindrical fixing roller 200, and a heater 202 composed of electrical resistance wires extending through the fixing roller 200 is fixed in place between the two end walls 198 of the upper frame 182. Furthermore, shaft support recesses 204 are formed at both end walls 198, and a shaft 208 having a paper transfer roller 206 fixed thereto is rotatably mounted on the shaft support recesses 204.

Figure 10:
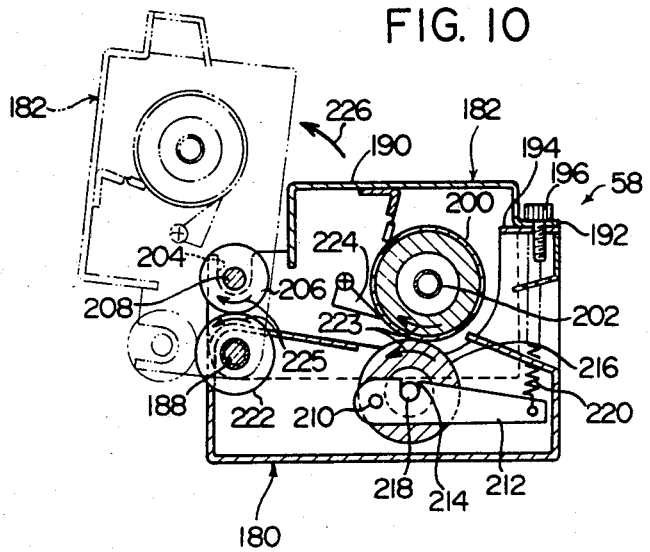
FIG. 10 is a sectional view of a fixing mechanism used in the electrostatic copying apparatus shown in FIGS. 1 and 2.

As FIG. 10 shows, a shaft support lever 212 is pivotably mounted on the inside surface of each of the two end walls 186 of the lower frame 180 by means of a pin 210. A shaft support recess 214 is formed in the lever 212, and a support shaft 218 of a fixing roller 216 cooperating with the fixing roller 200 is mounted rotatably on the shaft support recess 214. Between the free end of the shaft support lever 212 and the upper end portion of the end wall 186 is connected a spring 220 which elastically biases the shaft support lever 212 counterclockwise in FIG. 10 and thus elastically urges the fixing roller 216 against the fixing roller 200. A paper transfer roller 222 cooperating with the paper transfer roller 206 is fixed to the shaft 188 mounted rotatably between the two end walls 186 of the lower frame 180.

In the fixing mechanism 58 having the above construction, the fixing rollers 200 and 216 are rotationally driven in the direction shown by an arrow 223, and the paper transfer rollers 206 and 222, in the direction shown by an arrow 225. A current is supplied to the heater 202 and thus the fixing roller 200 is heated. In this condition, a copying paper having a developed image transferred thereto from the photosensitive member 70 (FIG. 3) in the transfer zone 20 (FIG. 2) is supplied between the fixing rollers 200 and 216 from right in FIG. 10. As a result, the developed image on the copying paper is fixed under pressure by the pressure between the two fixing rollers 200 and 216, and simultaneously, the developed image on the copying paper is thermally fixed by the heat transmitted from the heater 202 to the copying paper via the fixing roller 200. The copying paper which has thus undergone the fixing action of the fixing rollers 200 and 216 is sent between the paper transfer rollers 206 and 222, and discharged onto the receiver tray 60 (FIG. 2) by the transferring action of the paper transfer rollers 206 and 222. In order to prevent the copying paper from adhering to, and wrapping about, the surface of the fixing roller 200 during the fixing operation between the fixing rollers 200 and 216, it is possible to form a suitable coating such as a tetrafluoroethylene or silicone resin on the surface of the fixing roller 200 and to provide a peeling member 224 having a knife-like edge in proximity to the surface of the fixing roller 200.

In the fixing mechanism 58 of the above construction, any paper jamming which may occur particularly at the sites of the fixing rollers 200 and 216 can be very easily eliminated. When paper jamming occurs in the fixing mechanism 58, the first thing to do is to open the front wall of the housing 2 and move the lower frame 180 in a direction perpendicular to the sheet surface in FIG. 2 along the support rails 184 (FIG. 2) thereby to draw out the entire fixing mechanism 58 from the housing 2. Then, the setscrew 196 connecting the upper frame 182 to the lower frame 180 is removed, and the upper frame 182 is caused to pivot in the direction shown by an arrow 226 in FIG. 10 to bring it to the position shown by a two-dot chain line in FIG. 10. As a result, the inside of the fixing mechanism 58 is opened, and the copying paper jammed therein can be very easily removed. After the jammed paper has been removed, the above operation is carried out in the reverse order to return the fixing mechanism 58 to the required operating position.

COOLING SYSTEM

Figure 11:
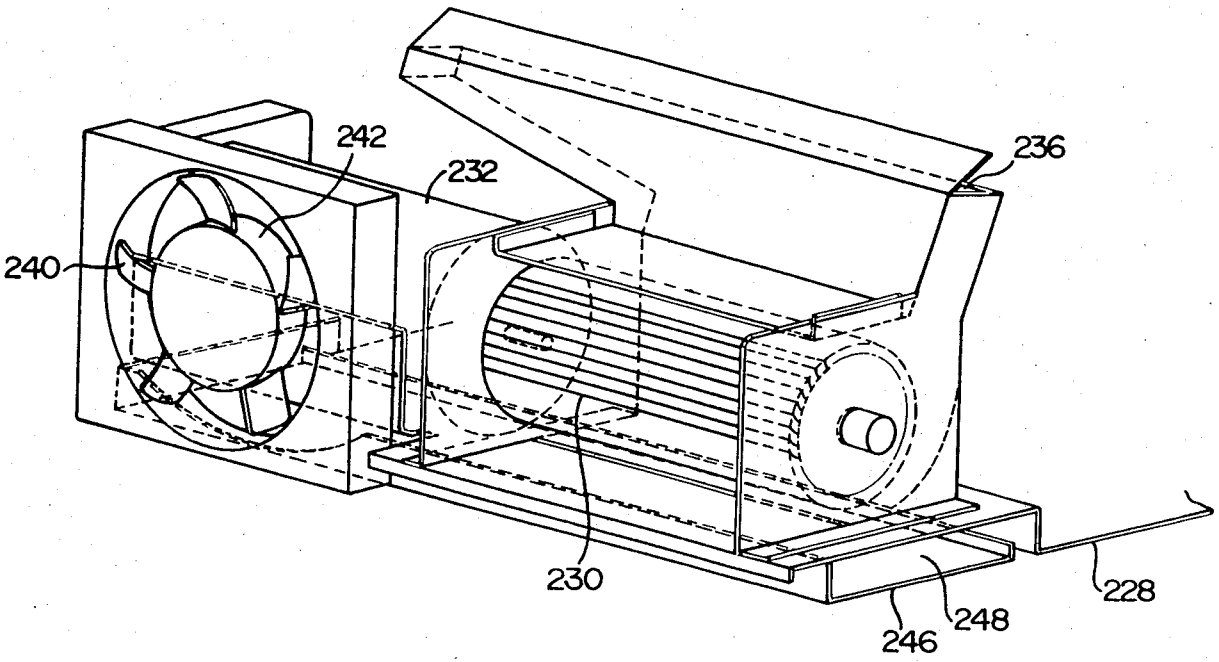
FIG. 11 is a perspective view showing a first fan and a second fan used in the electrostatic copying apparatus shown in FIGS. 1 and 2.

With reference to FIG. 11 together with FIG. 2, the cooling system is described. As FIG. 2 shows, a partitioning wall 228 is provided in that portion of the housing 2 which is at the left of the rotary drum 12. The partitioning wall 228 divides the inside space of the housing 2 into an upper portion in which the optical unit 32 is located and a lower portion in which the paper transfer system 46 and the fixing mechanism 58 are located. A first fan 230 for cooling which is the same as in conventional electrostatic copying machines is disposed above the partitioning wall 228 in the vicinity of the left end portion of the housing 2. In the illustrated embodiment, the first fan 230 composed of a siloccotype fan is drivingly connected to a main electric motor 232 disposed rearwardly thereof, for example, by being directly coupled to the output shaft of the motor 232. The main electric motor 232, like main electric motors in conventional electrostatic copying machines, is drivingly connected to driving elements (not shown) for the rotary drum 12, the original-support mechanism 4, the paper transfer unit 46, etc. Upon energization of the main electric motor 232, the first fan 230 is rotationally driven thereby to suck the air from vents 234 formed in the left end wall of the housing 2, send the air to a passageway 236, allow it to pass through the optical unit 32, particularly the vicinity of the original-illuminating lamp 36, thereby cooling it and discharge it from vents 238 formed at the upper portion of the right end wall of the housing 2 (or vents formed in the top surface wall of the housing 2).

The above construction of the cooling system, specifically the first fan 230, is also included in conventional electrostatic copying machines and is already known. However, since the cooling system in the conventional electrostatic copying machines includes only the construction of the first fan 230, it has the following problems or defects. When the fixing mechanism 58 is of the aforesaid type having electrical heater 202 (FIGS. 9 and 10), the heat released from the heater 202 is transmitted to the photosensitive member 70 (FIG. 3) on the rotary drum 12 and is likely to deteriorate the photosensitive member 70. It is strongly desired therefore to prevent the heat of the heater 202 exactly from being transmitted to the photosensitive member 70. On the other hand, the heat from the heater 202 cannot sufficiently be prevented from being transmitted to the photosensitive member 70 only by the air flow generated by the action of the first fan 230 described above. The reason for this is as follows: It is well known to those skilled in the art that the main electric motor 232 to which the first fan 230 is drivingly connected is energized generally at the time of starting the copying process by depression of a copying start switch following closing of the main switch of the electrostatic copying apparatus. Thus, the first fan 230 is actuated for the first time at the start of the copying process. On the other hand, a current is generally supplied to the heater 202 of the fixing mechanism 58 as soon as the main switch is closed, because the fixing roller 200 needs to be heated to the required temperature by the time the fixing operation of the fixing mechanism is actually carried out. Accordingly, during the time from the closing of the main switch to the starting of the copying process and during the time from the ending of the copying process to the opening of the main switch, the first fan 230 is in the inoperative state but the heater 202 is in the electrified state. During such times, the heat released from the heater 202 is likely to be transmitted to the photosensitive member 70 to degrade it.

In the illustrated electrostatic copying apparatus improved in accordance with this invention, the cooling system also includes a second fan 240 capable of acting independently from the first fan 230, in order to solve or remove the aforesaid problems or defects. In the illustrated embodiment, the second fan 240 composed of an axial flow-type fan is disposed rearwardly of the first fan 230 and on the left side of the main electric motor 232 as can be understood from FIGS. 2 and 11. The second fan 240 is located bridging both the upper and lower portions of the housing 2 defined by the partitioning wall 228, so that it can act both on the upper and lower portions of the housing 2. An auxiliary electric motor 242, separate from the main electric motor 232, is associated with the second fan 240. The auxiliary electric motor 242 is energized upon the closing of the main switch of the electrostatic copying apparatus, and is maintained in the energized state until the main switch is open. Accordingly, the second fan 240 operates upon the closing of the main switch and continues to operate until the main switch is opened.

In the upper portion of the housing 2, when the second fan 240 is actuated by the closing of the main switch, it sucks air from the vents 238 formed in the upper portion of the right end wall of the housing 2 (or vents formed in the top surface wall of the housing 2) and discharges the air from the vents 234 formed in the left end wall of the housing 2 through the upper portion of the housing 2, thereby effectively discharging the heat which may stay in the upper portion of the housing 2 during the time from the closing of the main switch to the energization of the main electric motor 232 and during the time from the deenergization of the main electric motor 232 to the opening of the main switch and also more effectively cooling the upper portion of the housing 2 in cooperation with the first fan 230 while the main electric motor 232 is being energized. On the other hand, in the lower portion of the housing 2, the second fan 240 sucks the air from vents 244 formed in the lower part of the right end wall of the housing 2, passes the air through the lower portion of the housing 2, and therefore through the lower part of the rotary drum 12 and the vicinity of the fixing mechanism 58 and then through a passageway 248 defined between the partitioning wall 228 and a guide plate 246 beneath it, and discharges it from the vents 234 formed in the left end wall of the housing 2, thereby exactly preventing the heat of the heater 202 of the fixing mechanism 58 from being transmitted to the photosensitive member 70 (FIG. 3) on the rotary drum 12.

MANUAL PAPER-POSITIONING MECHANISM

In the illustrated electrostatic copying apparatus, it is usual that the paper cassette 50 is mounted on the cassette-receiving section 48 of the paper transfer unit 46 mentioned hereinabove with reference to FIG. 2, and in performing the copying process, a copying paper sheet of a predetermined size included in the cassette 50 is supplied to a paper transfer passage and a developed image corresponding to the image of an original document to be copied is formed on the copying paper sheet of the predetermined size. Not infrequently, however, it is desired to form a developed image corresponding to the image of an original document to be copied on the surface of a copying paper of an arbitrary size, a master copying paper for utilization in offset printing, etc. instead of copying sheets of predetermined sizes (for example, B4, A4, and A5 according to JIS) stacked in the cassette 50.

According to one aspect, the apparatus of this invention is equipped with a manual paper-positioning mechanism mounted on the cassette-receiving section 48 in place of the paper cassette 50 and adapted to position a copying paper manually so that it can be fed to the copying paper transfer passage by the action of the paper feed roller 52 provided at the cassette-receiving section 48.

Figure 12:
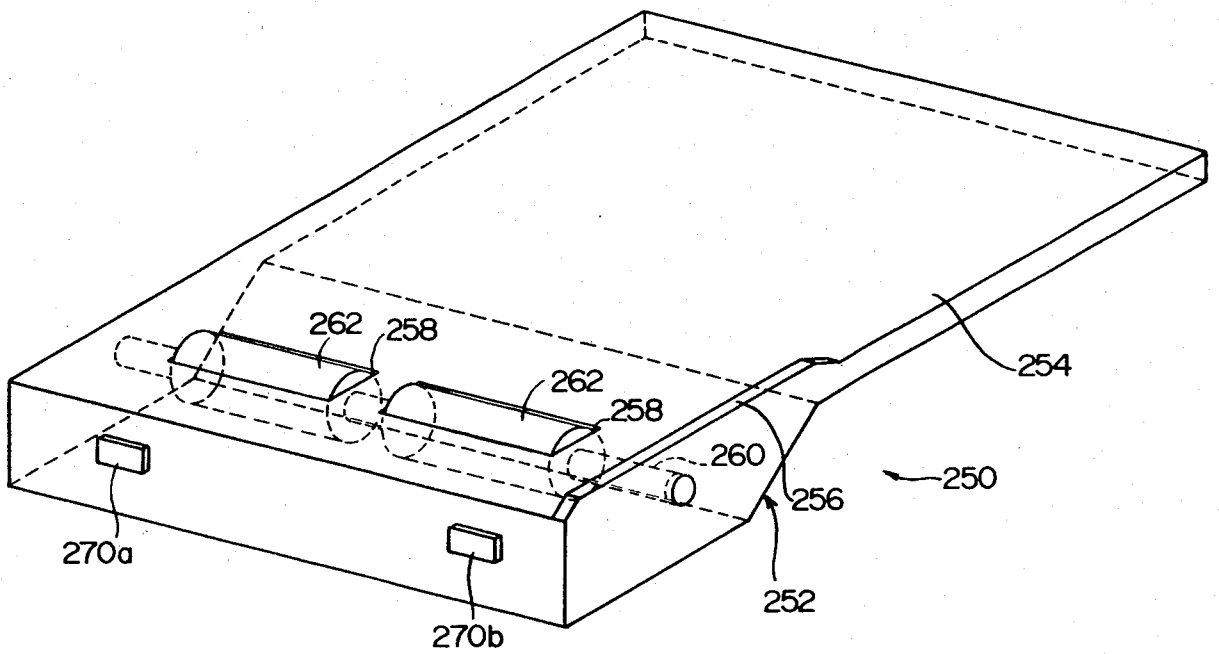
FIG. 12 is a perspective view showing a manual paper-positioning mechanism applied to the electrostatic copying apparatus shown in FIGS. 1 and 2.
Figure 13:
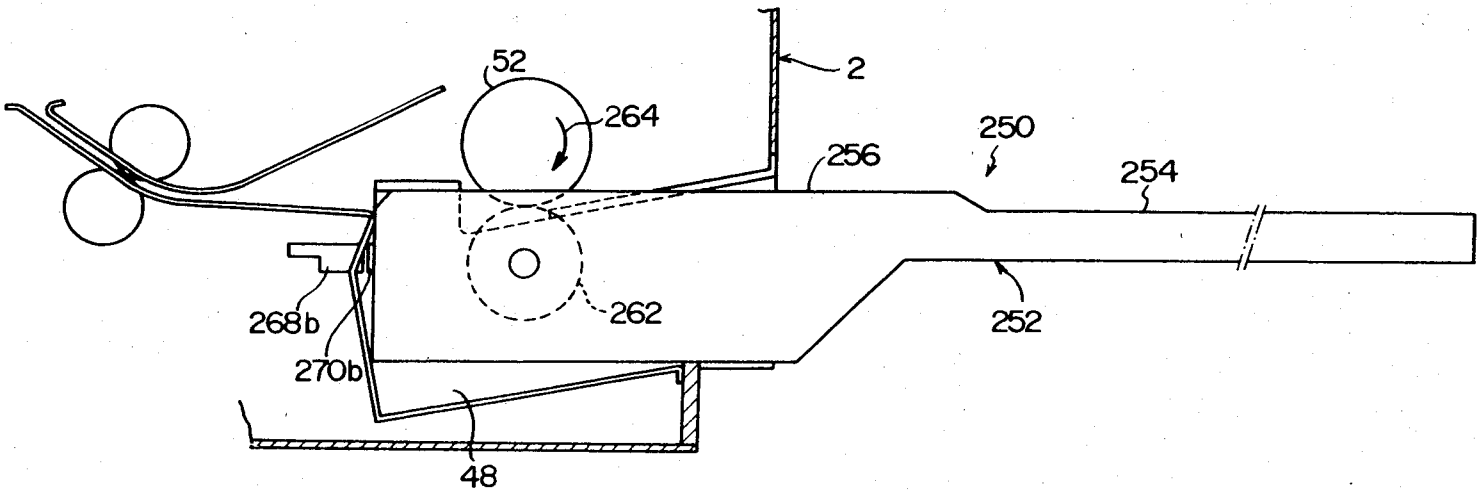
FIG. 13 is a sectional view showing the manual paper-positioning mechanism shown in FIG. 12 being applied to the electrostatic copying apparatus shown in FIGS. 1 and 2.

Referring to FIGS. 12 and 13, the manual paper-positioning mechanism shown generally at 250 includes a frame 252. At least a front end portion of the frame 252 has a contour similar to the front end portion of the paper cassette 50 so that it can be inserted into the cassette-receiving section 48 of the housing 2 and mounted in position instead of the paper cassette 50 (FIG. 2). The top surface of the frame 252 defines a preferably flat guiding top surface 254 for guiding a copying paper to be positioned as required by a manual operation (namely, in such a manner that the paper may be fed into the paper transfer passage by the action of the paper feed roller 52). In at least a front end portion of one edge portion of the guide top surface 254, there can be provided a protruding piece 256 whose inside surface defines an upstanding guide surface for guiding one edge of at least a front end portion of a copying paper to be positioned manually as required. At least one (two in the drawings) opening 258 is formed in the top surface of the frame 252 which defines the guiding top surface 254. On the other hand, a shaft 260 is rotatably mounted to the front end portion of the frame 252, and an auxiliary roller 262 is fixed to the shaft 260 with the upper portion of its peripheral surface projecting upward through the opening 258.

When it is desired to position a given copying paper as required by a manual operation, the manual paper-positioning mechanism 250 described above is mounted on the cassette-receiving section 48 of the housing 2 as shown in FIG. 13 instead of the paper cassette 50 (FIG. 2). As a result, the peripheral surfaces of the auxiliary rollers 262 of the manual paper-positioning mechanism 250 come into engagement with the peripheral surface of the paper feed roller 52 disposed at the cassette-receiving section 48. In this regard, in order to bring the peripheral surfaces of the auxiliary rollers 262 accurately into engagement with the peripheral surface of the paper feed roller 52, it is possible, if desired, to mount the shaft 260 for free vertical movement with respect to the frame 252 over a predetermined range, and to elastically bias the shaft 260 upwardly by means of a suitable spring (not shown) thereby pressing the peripheral surfaces of the auxiliary rollers 262 elastically against the peripheral surface of the paper feed roller 52.

After the manual paper-positioning mechanism 250 has been mounted as required to the cassette-receiving section 48, it is only sufficient to advance manually the copying paper along the guiding top surface 254 and to cause its leading end to be nipped between the paper feed roller 52 and the auxiliary rollers 262. When in this condition, the copying process by the electrostatic copying apparatus is started and the paper feed roller 52 is caused to begin rotation in the direction of arrow 264 at a certain time, the copying paper located on the guiding top surface 254 is fed to the copying paper transfer passage by the action of the paper feed roller 52. When one edge of the copying paper is contacted with the upstanding guide surface defined by the inside surface of the projecting piece 256 during the advancing of the copying paper by hand along the guiding top surface 254, the copying paper is positioned properly in the widthwise direction (the direction perpendicular to the sheet surface in FIG. 13). Thus, when the paper passes through the transfer zone 20 (FIG. 2), the one edge portion of the copying paper is positioned in mating relation with the annular groove 72 (FIG. 73) formed in one edge portion of the peripheral surface of the rotary drum 12.

OPERATIONAL CONTROL

With regard to the operational control of various constituent elements of the electrostatic copying apparatus, various improvements made in accordance with some aspects of this invention are described item by item.

DETECTION OF THE SIZE OF PAPER

According to one aspect of this invention, the operations of various constituent elements of the electrostatic copying apparatus are controlled on the basis of the longitudinal size of a copying paper transferred through the transfer zone 20 by the transfer unit 46, particularly the size of a copying paper contained in the cassette 50 mounted to the cassette-receiving section 48 (therefore, the paper fed by the action of the feed roller 52 and transferred through the transfer zone 20).

In order to perform such an operational control, the illustrated electrostatic copying apparatus includes a paper size display means at the cassette 50 (FIG. 2) mounted to the cassette-receiving section 48, and a sensing means for sensing the paper size display means is provided in the cassette-receiving section 48. The paper size display means and the sensing means constitute means for detecting the size of paper.

Stated in detail, in the illustrated electrostatic copying apparatus, one of four types of paper cassettes 50 including copying paper sheets of sizes A5, B5, A4 and B4 according to JIS is selectively mounted to the cassette-receiving section 48 provided at the lower part of the right end portion of the housing 2, as shown in FIG. 2. Since the illustrated electrostatic copying apparatus is constructed such that each of the various types of paper cassettes 50 can be mounted selectively to one cassette-receiving section 48, it is convenient that irrespective of the sizes of the copying papers in the cassettes, at least the front end portion of the cassettes are formed in the same contour so that they can be mounted as required in the same configuration substantially on the cassette-receiving section 48.

The various copying paper cassettes 50 to be selectively mounted on the cassette-receiving section 48 are provided each with a paper size display means for displaying the size of papers accomodated therein. One example of the paper size display means is described below when the electrostatic copying apparatus includes four types of cassettes (A5, B5, A4 and B4 sizes) as described above. Referring to FIGS. 14-A to 14-D, two display positions 266*a* and 266*b* are defined at predetermined parts of the front surface of each copying paper cassette 50. In the A5 paper cassette 50 (A5) shown in FIG. 14-A, no magnet exists at either of the two display positions 266*a* and 266*b*. In the B5 paper cassette 50 (B5) shown in FIG. 14-B, a magnet exists at the display position 266*a*, and no magnet exists at the display position 266*b*. In the A4 paper cassette 50 (A4) shown in FIG. 14-C, no magnet exists at the display position 266*a* and a magnet exists at the display position 266*b*. In the B4 paper cassette 50 (B4) shown in FIG. 14-D, a magnet exists both at the display positions 266*a* and 266*b*. The presence of a magnet in FIGS. 14-A to 14-D is indicated by blackening of the display positions.

The sensing means for sensing the paper size display means described above is provided at the cassette-receiving section 48. The sensing means in the illustrated embodiment is comprised of reed switches 268*a* and 268*b* (only 268*b* is shown in FIGS. 2 and 13, and both are shown in the block diagrams to be described hereinbelow) which are located opposite to the display positions 266*a* and 266*b* respectively and are adapted to be closed by the action of a magnetic field which may be generated by the magnets at the display positions 266*a* and 266*b*.

In the paper size detecting means comprised of the paper size display means and the sensing means, the reed switches 268*a* and 268*b* remain open when the A5 paper cassette 50 (A5) has been mounted to the cassette-receiving section 48. When the B5 paper cassette 50 (B5) is mounted to the cassette-receiving section 48, the reed switch 268*a* is closed, and when the cassette-receiving section 48 receives the A4 paper cassette 50 (A4), the reed switch 268*b* is closed. When the B4 paper cassette 50 (B4) is mounted to the cassette-receiving section 48, both the reed switches 268*a* and 268*b* are closed. Now, let the open condition of each of the reed switches 268*a* and 268*b* be "0", its closed condition be "1", the condition of the reed switch 268*a* be indicated at the first place and the condition of the reed switch 268*b* be indicated at the second place, then the sizes of the individual copying papers can be expressed by a binary system as shown in Table 1 below.

TABLE 1

| Size of paper | Reed switch 268a | Reed switch 268b | Binary notation |
|---|---|---|---|
| A5 | 0 | 0 | 0 |
| B5 | 1 | 0 | 1 |
| A4 | 0 | 1 | 2 |
| B4 | 1 | 1 | 3 |

As already stated with reference to FIGS. 12 and 13, the illustrated electrostatic copying apparatus may also have the manual paper-positioning mechanism 250 mounted instead of the paper cassette 50. As shown in FIG. 12, magnets 270*a* and 270*b* are disposed at the front surface of the frame 252 of the manual paper-positioning mechanism 250 at positions mating with the display positions 266*a* and 266*b*. Accordingly, when the manual paper-positioning mechanism 250 is mounted to the cassette-receiving section 48, the reed switches 268*a* and 268*b* assume the same condition as when the B4 paper cassette 50 (B4) is mounted, namely the condition indicated by "3" in the binary notation.

Since in the illustrated embodiment, four types of the copying paper cassettes 50 are used selectively, the two display positions 266*b* are defined at the front surface of the cassette 50 and the two reed switches 268*a* and 268*b* are disposed at the cassette-receiving section 48. However, when only two types of paper cassettes 50 are used selectively, it is sufficient to provide one display position and one reed switch. Conversely, when five or more types of copying paper cassettes are used, three or more display positions and reed switches can respectively be provided. If desired, instead of the combination of a magnet and a reed switch at the display position, other suitable combinations, for example a combination of a protrusion and a limit switch, may also be used.

MECHANISM FOR DETECTING THE MOVEMENT OF THE ORIGINAL-SUPPORT MECHANISM (OR THE OPTICAL UNIT)

As already stated with reference to FIG. 2, in the illustrated electrostatic copying apparatus, scanning movement of the original-support mechanism 4 causes the image of an original document placed on the transparent plate 8 of the original-support mechanism 4 to be scanned and projected upon the photosensitive member 70 (FIG. 3). As will be described in more detail hereinbelow, according to one aspect of this invention, the operations of the various elements of the electrostatic copying apparatus are controlled on the basis of the movement of the original-support mechanism 4 (or instead of the movement of the original-support mechanism 4, movement of at least a part of the optical unit 32 when the electrostatic copying apparatus is of the type wherein by moving at least a part of the optical unit 32 instead of the end original-support mechanism 4, the image of the original document on the transparent plate 8 of the original-support mechanism 4 is scanned and projected upon the photosensitive member 70) as well as the size of the copying paper as described above.

In order to perform this operational control, the illustrated electrostatic copying apparatus uses the following construction for detecting the movement of the original-support mechanism 4 (or at least a part of the optical unit 32).

Referring to FIG. 15 and FIGS. 16-A to 16-D in conjunction with FIG. 2, the illustrated electrostatic copying apparatus, as shown by the two-dot chain line in FIG. 2, and partly shown in FIGS. 16-A to 16-D, includes a known chain mechanism 272 as a power transmitting element for drivingly connecting the original-support mechanism 4 to the main electric motor 232 (FIG. 11). The chain mechanism 272 consists of a pair of sprocket wheels 274*a* and 274*b* rotatably mounted in spaced-apart relationship in the moving direction of the original-support mechanism 4 and an endless chain 276 wrapped about the sprocket wheels 274*a* and 274*b*. One of the sprocket wheels of the chain mechanism 272, for example the sprocket wheel 274*a*, is drivingly connected to the main electric motor 232 (FIG. 11) through a suitable power transmitting element (not shown), and the endless chain 276 is driven in the direction shown by an arrow 278 by the power transmitted from the main electric motor 232 to the sprocket wheel 274*a*. On the other hand, a follower plate 280 extending perpendicularly downwardly is fixed to the support frame 6 to the original-support mechanism 4. In the follower plate 280 is formed an elongated slot 282 which extends in the perpendicular direction along a length corresponding to the distance between the upper travelling section and the lower travelling section of the endless chain 276. A cam roller 284 mounted on, and adapted to move with, the endless chain 276 is engaged with the slot 282.

The chain mechanism 272, the follower plate 280 and the cam roller 284 are known elements, and the detailed structures and operations of these elements are described, for example, in Japanese Laid-Open Patent Publication No. 136336/1979, and a description thereof is therefore omitted in the present application. It is to be noted however that the follower plate 280 constitutes an actuating piece which acts on a pivoting piece to be described below.

Within the housing 2, a mounting bracket 286 (FIG. 15) is disposed at a fixed position with respect to the moving path of the follower plate 280 whose lower part constitutes an actuating piece. To the mounting bracket 286 are mounted a pivoting piece 288, two normally open switches 290 and 292 (as will be stated hereinbelow, the normally open switch 290 constitutes a normally open switch for lamp illumination used to turn on an illuminating lamp 36 of the optical unit 32, and the normally open switch 292, a normally open switch for initiation of actuation used to initiate the operation of the charging corona-discharge device 22, etc.), and a locking means 294. The pivoting piece 288 is pivotably mounted to the mounting bracket 286 by means of a pin 296. Normally, the pivoting piece 288 is elastically biased to the inoperative position shown in FIGS. 15 and 16-A by the action of a suitable spring and a stop piece (not shown). But as will be described in detail below, it can be turned in the direction of arrow 298 by the lower portion (i.e., the actuating piece) of the follower plate 280 and brought to the operative position shown in FIGS. 16-C and 16-D. The locking means 294 composed of a lever-like member mounted pivotably to the bracket 286 by means of a pin 300 is normally biased elastically to the position shown in FIGS. 15, 16-A, 16-C and 16-D by the action of a suitable spring and stop piece (not shown), but can be caused to pivot in the direction shown by an arrow 304 by the pivoting piece 288 and a lock releasing piece 302 secured to the endless chain 276 as will be described in detail hereinbelow.

There will be described below the operation of the detecting switch mechanism comprised of the actuating piece (the lower portion of the follower plate 280), the pivoting piece 288, the normally open switches 290 and 292, the locking means 294 and the lock releasing piece 302.

When the original-support mechanism 4 makes a preparatory movement from the stop position shown by a solid line in FIG. 2 to the right in FIG. 2 (to the left in FIGS. 16-A to 16-D) toward a scan movement-starting position shown by a two-dot chain line 4A in FIG. 2 and approaches the scan movement-starting position, one edge of the follower plate 280 abuts a receiving portion 306 of the pivoting piece 288 as shown in FIG. 16-A. As the original-support mechanism 4 further makes a preparatory movement, the one edge and lower edge of the follower plate 280 act on the receiving portion 306 of the pivoting piece 288 to turn the pivoting piece 288 in the direction of an arrow 298 against the elastic biasing action of the spring (not shown), as can be understood from FIGS. 16-A to 16-B. When the pivoting piece 288 is turned in the direction shown by arrow 298, a projection 308 formed on the pivoting piece 288 abuts the locking means 294 as shown in FIG. 16-B thereby pivoting the locking means 294 in the direction shown by an arrow 304 against the elastic biasing action of a spring (not shown). When the original-support mechanism 4 continues to make a preparatory movement, that site of the lower edge of the follower plate 280 which projects downwardly acts on the receiving portion 306 of the pivoting piece 288 as shown in FIG. 16-C to pivot the pivoting piece 288 to its critical position shown in FIG. 16-C. When the pivoting piece 288 has been turned to the critical position, the projection 308 of the pivoting piece 288 gets into a recess 310 formed in the locking means 294, whereby the locking means 294 returns to the initial position (the positions shown in FIGS. 15, 16-A, 16-C and 16-D) by the elastic biasing action of the spring (not shown). As a result, the recess 310 of the locking means 294 comes into engagement with the projection 308 of the pivoting piece 288 to lock the pivoting piece 288 at the critical position illustrated in FIG. 16-C. Accordingly, the pivoting piece 288 is kept at the critical position illustrated in FIG. 16-C by the locking action of the locking means 294 even when after the preparatory movement, the original-support mechanism 4 moves to the scanning movement-starting position shown by the two-dot chain line 4A in FIG. 2 and further makes a scanning movement to the left in FIG. 2 (to the right in FIGS. 16-A to 16-D) toward a scanning movement-ending position shown by the two-dot chain line 4B in FIG. 2 thereby causing the follower plate 280 to depart from the pivoting piece 288. When the original-support mechanism 4 continues to make a scanning movement and approaches the scanning movement-ending position, the lock releasing piece 302 mounted on the endless chain 276 of the chain mechanism 272 approaches the locking means 294 as shown in FIG. 16-D. As the original-support mechanism 4 continues to make the scanning movement, the lock releasing piece 302 acts on the locking means 294 to pivot the locking means 294 in the direction of an arrow 304 against the elastic biasing action of the spring (not shown). As a result, the recess 310 of the locking means 294 comes out of engagement with the projection 308 of the pivoting piece 288, and therefore the locking action of the locking means 294 is released. Thus, the pivoting piece 288 is returned to the inoperative position, i.e. the inoperative position shown in FIGS. 15 and 16-A, by the elastic biasing action of the spring (not shown). The locking means 294 itself is returned to the aforesaid initial position by the elastic biasing action of the spring (not shown) when the lock releasing piece 302 comes out of engagement with the locking means 294 as a result of continued scanning movement of the original-support mechanism 4.

On the other hand, when the pivoting piece 288 is caused to pivot from the inoperative position shown in FIG. 16-A to the critical position shown in FIG. 16-C in the direction shown by the arrow 298, and therefore when the original-support mechanism 4, after approaching the scaning movement-starting position shown by the two-dot chain line 4A in FIG. 2, continues to make a preparatory movement and reaches the scan movement-starting position, the aforesaid two normally open switches 290 and 292 are successively closed by the action of the pivoting piece 288. As can be easily appreciated from FIGS. 16-A and 16-B, when the pivoting piece 288 has pivoted from the inoperative position shown in FIG. 16-A in the direction shown by the arrow 298, a first cam surface 312 in a nearly 180° arcuate shape acts on an actuator 314 of the normally open switch 290 to close the normally open switch 290. When the pivoting piece 288 is further turned from the position shown in FIG. 16-B to the critical position shown in FIG. 16-C, a second cam surface 316 in a nearly 100° arcuate shape acts on an actuator 318 of the normally open switch 292 to close the normally open switch 292. In other words, in its turning from the inoperative position shown in FIG. 16-A to the critical position shown in FIG. 16-C in the direction of the arrow 298, the pivoting piece 288 first closes the normally open switch 290, and then after some time interval, closes the normally open switch 292. The closed normally open switches 290 and 292 closed by the action of the pivoting piece 288 return to the open state when the pivoting piece 288 is returned to the inoperative position in the manner described above (therefore when the original-support mechanism 4 has made a scanning movement and approached or reached the scanning movement ending position shown by the two-dot chain line 4B in FIG. 2).

The illustrated electrostatic copying apparatus further includes the following construction in order to detect the movement of the original-support mechanism 4.

Figure 17:
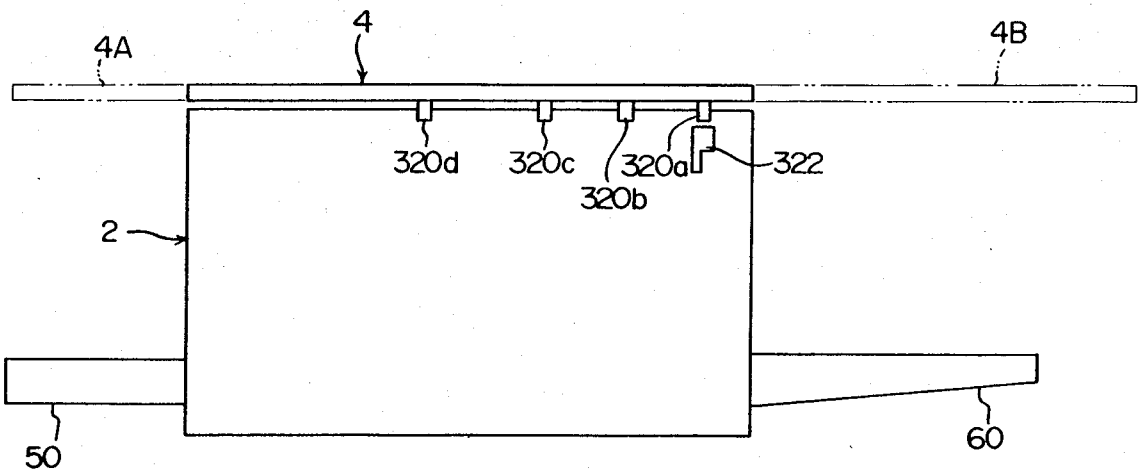
FIG. 17 is a simplified view showing actuators and a driven member used in the electrostatic copying apparatus shown in FIGS. 1 and 2.

As schematically shown in FIG. 17, the undersurface of the original-support mechanism 4 has provided thereon a plurality of actuators (first, second, third and fourth actuators 320*a*, 320*b*, 320*c* and 320*d* in the illustrated embodiment) at predetermined intervals in the moving direction of the original-support mechanism 4. At a predetermined position within the housing 2 is disposed a driven member 322 which undergoes the action of the actuators 320*a*, 320*b*, 320*c* and 320*d*. The actuators 320*a*, 320*b*, 320*c* and 320*d* which can be formed of, for example, magnets successively act on the driven member 322 which can be formed, for example, of a reed switch when the original-support mechanism 4 makes a scanning movement from the scan movement-starting position shown by the two-dot chain line 4A to the right in FIG. 17 to the scan movement-ending position shown by the two-dot chain line 4B. The driven member 322 produces a signal every time it is acted upon by the actuators 320*a*, 320*b*, 320*c* and 320*d* successively. In the illustrated embodiment, the first, second third and fourth actuators 320*a*, 320*b*, and 320*c* and 320*d* and the driven member 322 are positioned in such a manner that the first actuator 320*a* acts on the driven member 322 when the original-support mechanism 4 makes a scanning movement from the scan movement-starting position shown by the two-dot chain line 4A by a distance corresponding to the longitudinal size of an A5-size copying sheet in accordance with JIS standards (the size of the copying paper in the moving direction, which paper is fed from the paper cassette 50); the second actuator 320*b* acts on it when the original-support mechanism 4 further makes scanning movement and advances by a distance corresponding to the longitudinal size of a B5-size copying paper in accordance with JIS standards from the scan movement-starting position; the third actuator 320*c* acts on it when the original-support mechanism 4 moves from the scan movement-starting position by a distance corresponding to the longitudinal size of a A4-size copying paper in accordance with JIS standards; and the fourth actuators 320*d* acts on it when the original-support mechanism 4 moves from the scan movement-starting position by a distance corresponding to the longitudinal size of a B4-size copying paper in accordance with JIS standards.

VISIBLE DISPLAYING OF THE SIZE OF A COPYING PAPER

Figure 18:
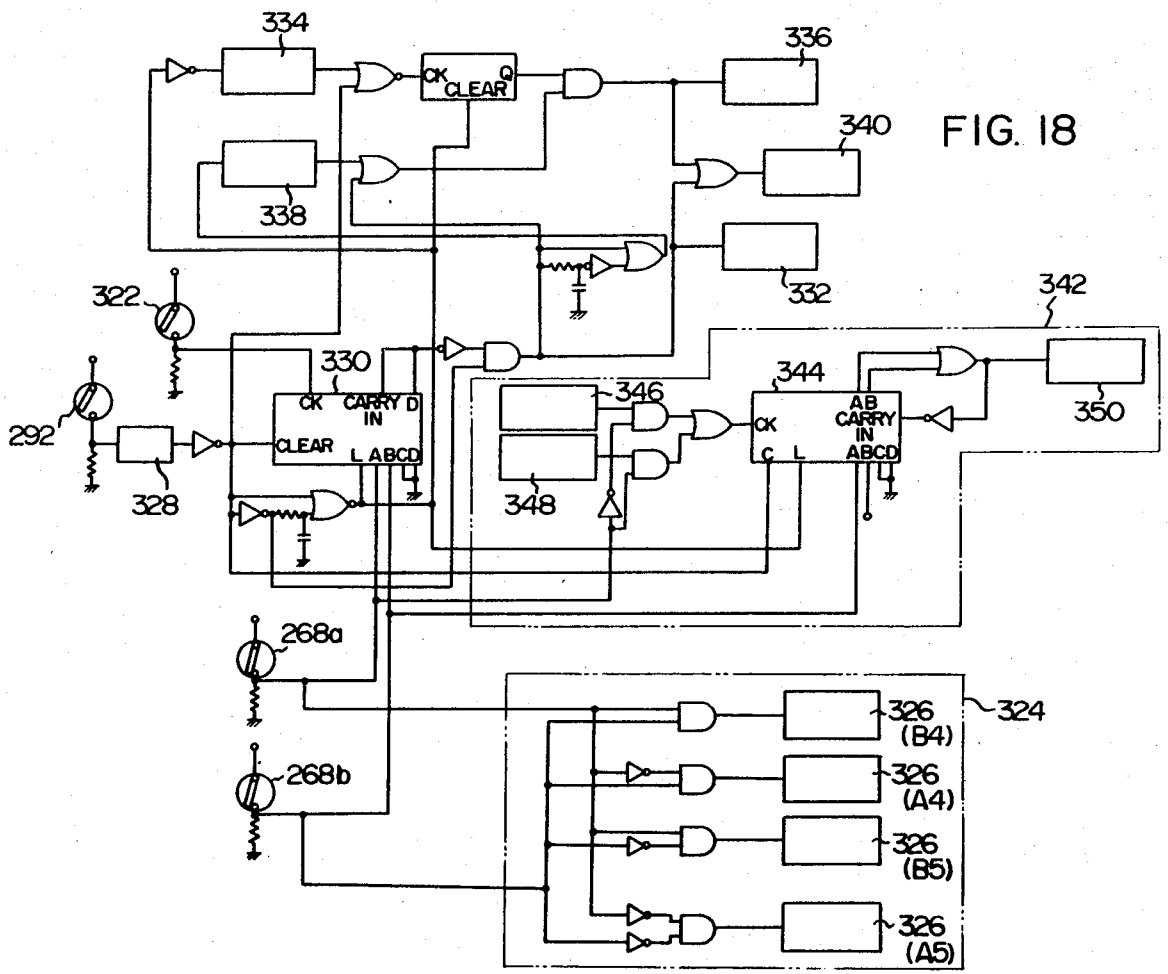
FIG. 18 is a block diagram showing a part of a control electrical circuit used in the electrostatic copying apparatus shown in FIGS. 1 and 2.

Now, with reference to FIG. 18 which is a block diagram showing in a simplified manner a part of a control electrical circuit used in the illustrated electrostatic copying apparatus, a visible paper size displaying means shown generally at 324 for performing visible display of the paper cassette 50 (see FIG. 2) mounted to the cassette-receiving section 48 described above is connected to the reed switches 268*a* and 268*b* (see FIGS. 12 and 13) which constitute the sensing means in the paper size detecting means. The visible paper size displaying means 324 includes an A5-size displayer, a B5-size displayer, an A4-size displayer and a B4-size displayer (not shown) which may be composed of suitable lamps, for example, and an A5-size displayer energizing circuit 326 (A5), a B5-size displayer energizing circuit 326 (B5), an A4-size displayer energizing circuit 326 (A4) and a B4-size displayer energizing circuit 326 (B4) associated respectively with these displayers. In the state shown in FIG. 18, both of the reed switches 268*a* and 268*b* are closed by the mounting of the B-4 size paper cassette 50 (B4) shown in FIG. 14-D to the cassette-receiving section 48. As can be readily appreciated from FIG. 18, in such a state, the B4-size displayer energizing circuit 326 (B4) is actuated whereby the B4-size displayer (not shown) visibly indicates that the B4-size paper cassette 50 (B4) is mounted to the cassette-receiving section 48. When in place of the cassette 50 (B4), the A5-size paper cassette 50 (A5) shown in FIG. 14-A is mounted on the cassette-receiving section 48, both the reed switches 268*a* and 268*b* are opend to actuate the A5-size displayer energizing circuit 326 (A5) whereby the A5-size displayer (not shown) visibly indicates that the A5-size paper cassette 50 (A5) is mounted to the cassette-receiving section 48. Furthermore, when the B5-size paper cassette 50 (B5) shown in FIG. 14-B is mounted to the cassette-receiving section 48, the reed switch 268*a* is closed and the reed switch 268*b* remains open to actuate the B5-size displayer energizing circuit 326 (B5) whereby the B5-size displayer (not shown) visibly indicates that the B5-size paper cassette 50 (B5) is set at the cassette-receiving section 48. Likewise, upon mounting of the A4-size paper cassette 50 (A4) shown in FIG. 14-C to the cassette-receiving section 48, the reed switch 268*a* is opened and the reed switch 268*b* is closed to actuate the A4-size displayer energizing circuit 326 (A4) whereby the A4-size displayer (not shown) visibly indicates that the A4-size paper cassette 50 (A4) is mounted to the cassette-receiving section 48.

CONTROLLING OF THE ORIGINAL-ILLUMINATING LAMP, THE CHARGING CORONA-DISCHARGE DEVICE AND THE TRANSFER CORONA-DISCHARGE DEVICE

Figure 19:
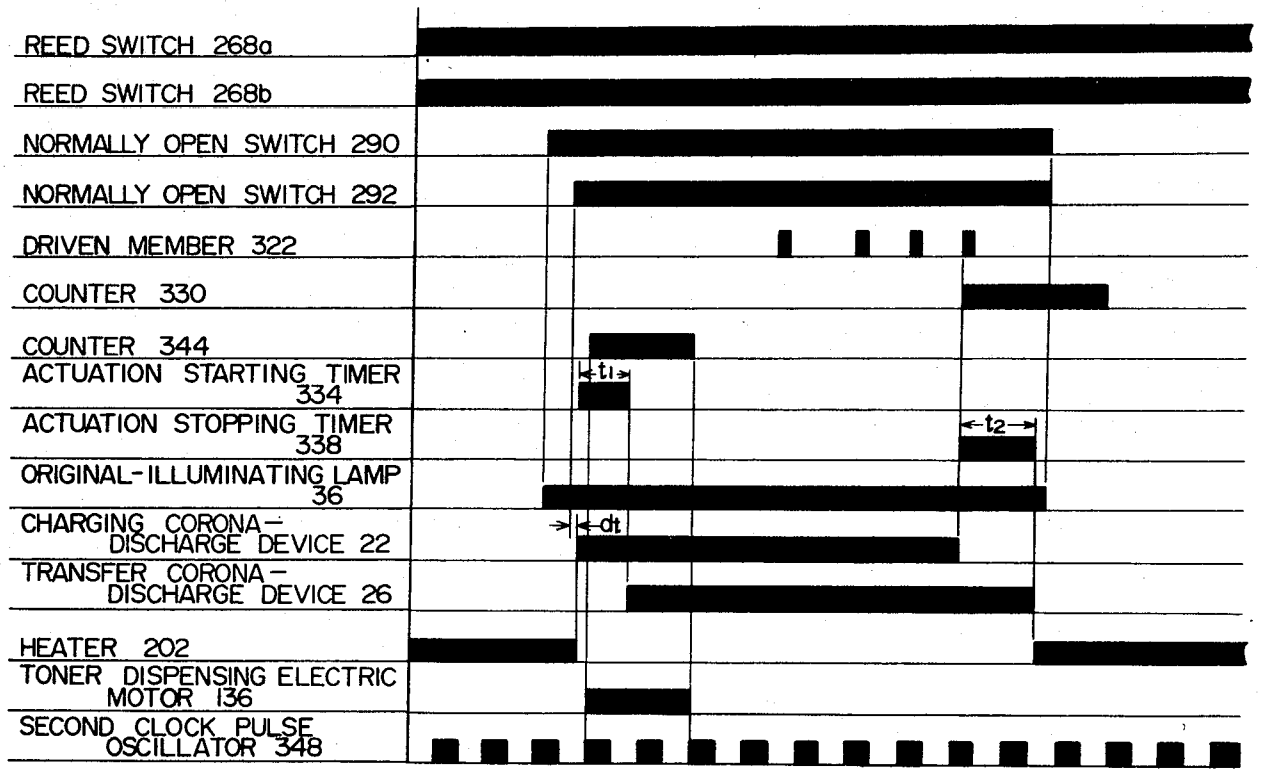
FIG. 19 is a time chart showing the states of the operations of various constituent elements used in the electrostatic copying apparatus shown in FIGS. 1 and 2.

Now, referring to FIG. 19 which is a time chart showing the state of operation of various constituent elements of the illustrated electrostatic copying apparatus in conjunction with FIGS. 2 and 18, controlling of the operations of the original-illuminating lamp 36 of the optical unit 32, the charging corona-discharge device 22 and the transfer corona-discharge device 26 will be successively described.

As already stated with reference to FIGS. 15 and 16-A to 16-D, when in the illustrated electrostatic copying apparatus the main switch (not shown) is closed and the copy starting switch (not shown) is closed to cause the original-support mechanism 4 to make a preparatory movement from the stop position shown by the solid line in FIG. 2 to the scan movement-starting position shown by the two-dot chain line 4A in FIG. 2, the actuator piece constructed of the lower portion of the follower plate 280 moving together with the original-support mechanism 4 causes the pivoting piece 288 to pivot, whereby the normally open switch 290 and the normally open switch 292 are successively closed with some time interval.

When the normally open switch 290 is closed, the original-illuminating lamp 36 of the optical unit 32 is turned on, as can be appreciated from FIG. 19. Since some period of time (the so-called rise time) is generally required from the lighting of the lamp to the time when the lamp is ready for performing the required operation, it is convenient to turn on the original illuminating lamp 36 a predetermined time before the original-support mechanism 4 starts to make a scanning movement from the scan movement starting position, namely before the scanning and exposing of an original document is started.

When, on the other hand, the normally open switch 292 is closed after the lapse of a certain period of time from the closing of the switch 290, an input signal is supplied to a timer (or a delay circuit) 328 connected to the normally open switch 292 as can be understood from FIG. 18, and the timer 328 produces an output signal after the lapse of an adjustable delay time dt (FIG. 19) from the receipt of the input signal. When the timer 328 produces the output signal, the following actions occur.

(1) Actuation of a counter 330 is started to actuate a circuit 332 for energizing the charging corona-discharge device whereby the actuation of the corona discharge device 22 is started. At the same time, signals from the reed switches 268*a* and 268*b* constituting the sensing means in the paper size detecting means are read into the counter 330. As already stated, in the state shown in FIG. 18, the B4-size paper cassette 50 (B4) is mounted to the cassette-receiving section 48 and the reed switches 268*a* and 268*b* are closed. Hence, as can be readily understood from Table 1, the numeral "3" in the binary notation is read into the counter 330. On the other hand, when the A5-size paper cassette 50 (A5) is mounted to the cassette-receiving section 48, the numeral "0" in the binary notation is read into the counter 330. Likewise, the numeral "1" and the numeral "2" in the binary notation are read into the counter respectively when the cassette 50 at the cassette-receiving section 48 is the B5-size paper cassette 50 (B5) and the A4-size paper cassette 50 (A5), respecrively.

(2) Simultaneously, an actuation starting timer 334 for starting the actuation of the transfer corona-discharge device 26 is actuated. The actuation starting timer 334 produces an output signal after the lapse of a predetermined time $t_1$ and supplies the output signal to a circuit 336 for energizing the transfer corona-discharge device 26. As a result, the energization circuit 336 is actuated to start the actuation of the transfer corona discharge device 26.

The actuation initiating means comprised of the normally open switch 292 and the timer 328 and capable of starting the actuation of the charging corona-discharge device 22 after the adjustable delay time dt from the closing of the normally open switch 292 can be set or adjusted so that it starts the actuation of the charging corona-discharge device 22 simultaneously with, immediately before, or immediately after, the starting of the scanning movement of the original-support mechanism 4 and therefore the starting of the scanning and exposing of the original document. Conveniently, it is set or adjusted in the following manner with respect to a copying paper transferred from the cassette 50 mounted to the cassette-receiving section 48 through the transfer zone 20. Specifically, it is convenient to set or adjust the delay time dt by the actuation starting means, especially the timer 328, such that the charging action of the corona discharge device 22 is started slightly upstream of that site of the photosensitive member 70 (FIG. 3) on the rotary drum 12 with which is mated in the transfer zone 20 the leading end of the copying paper which is transferred from the cassette 50 to the transfer zone 20 in synchronism with the scanning and exposing of the original document (or the rotation of the rotary drum 12) by means known to those skilled in the art. If such setting or adjustment is effected, when a developed image formed on the photosensitive member 70 is transferred to the copying paper in the transfer zone 20, some length of the leading end of the copying paper remains in the original state without the developed image transferred thereto. This can effectively prevent the firm adhesion of the leading end of the copying paper to the surface of the fixing roller 200 in the fixing mechanism 58, which causes extreme difficulty of paper separation (for details of the occurrence of such a phenomenon, reference may be had to Japanese Patent Publication No. 36502/1979, for example).

On the other hand, the time from the starting of the actuation of the charging corona-discharge device 22 to the starting of the actuation of the transfer corona-discharge device 26, i.e. the time $t_1$ defined by the actuation starting timer 334, can be set or adjusted so that it corresponds to the time required for a predetermined site on the photosensitive member 70 (FIG. 3) to move from a region where it undergoes the action of the charging corona-discharge device 22 to a region where it undergoes the action of the transfer corona-discharge device 26 by the rotation of the rotary drum 12.

When the original-illuminating lamp 36, the corona discharge device 22 and the transfer corona discharge device 26 are started, and the original-support mechanism 4 makes a scanning movement, a latent electrostatic image is formed on the photosensitive member 70 (FIG. 3) on the rotary drum 12, and then by the action of the developing device 24, the latent electrostatic image is developed to a visible image which is then transferred to a copying paper, as is well known to those skilled in the art.

As already described with reference to FIG. 17, in the scanning movement of the original-support mechanism 4 from the scanning movement starting position, the actuators 320*a*, 320*b*, 320*c* and 320*d* provided on the original-support mechanism 4 successively act on the driven member 322 disposed in the housing 2, and the driven member 322 produces a pulse signal every time it is acted upon by the actuators 320*a*, 320*b*, 320*c* and 320*d* as shown in FIG. 19. Specifically, in the illustrated embodiment, when the original-support mechanism 4 makes a scanning movement from the scanning movement starting position by a distance corresponding to the longitudinal size of an A5-size copying paper, a first pulse signal is produced. A second pulse signal is produced when it makes a scanning movement by a distance corresponding to the longitudinal size of a B5-size copying paper. When it makes a scanning movement by a distance corresponding to the longitudinal size of an A4-size copying paper, a third pulse signal is produced. Furthermore, a fourth pulse signal is produced when the original-support mechanism 4 makes a scanning movement by a distance corresponding to the longitudinal size of a B4-size copying paper. On the other hand, as can be readily understood from FIG. 18, the pulse signals produced by the driven member 322 are fed into the counter 330. Every time the counter 330 receives the pulse signal, its binary notation number read thereinto is decreased by one. When the counter 330 receives the pulse signal with the binary notation being "0", it produces an output signal. Accordingly, when a signal supplied to the counter 330 from the reed switches 268*a* and 268*b* constituting the sensing means of the paper size detecting means is "0" in the binary notation (that is, when the A5-size paper cassette 50 (A5) is mounted to the cassette-receiving section 48), the counter 330 produces an output signal upon receipt of the first pulse signal. When a signal supplied to the counter 330 from the reed switches 268*a* and 268*b* is "1" in the binary notation [that is, when the B5-size paper cassette 50 (B5) is mounted to the cassette-receiving section 48], the counter 330 produces an output signal upon receipt of the second pulse signal subsequent to the first pulse signal. When a signal supplied to the counter 330 from the reed switches 268*a* and 268*b* is "2" in the binary notation [that is, when the cassette A5-size paper cassette 50 (A4) is mounted to the cassette-receiving section 48], the counter 330 produces an output signal upon receipt of the third pulse signal subsequent to the first and second pulse signals. As illustrated in FIGS. 18 and 19, when a signal supplied to the counter 330 from the reed switches 268*a* and 268*b* is "3" in the binary notation, the counter 330 produces an output signal upon receipt of the fourth pulse signal subsequent to the first, second and third pulse signals. When the counter 330 produces the output signal, the following actions occur as will be understood from FIGS. 18 and 19.

(1) The actuation of the circuit 332 for energizing the charging corona-discharge device is stopped and the actuation of the corona discharge device 22 is stopped (accordingly, the actuators 320*a*, 320*b*, 320*c* and 320*d*, the driven member 322 and the counter 330 constitute means for stopping the actuation of the charging corona-discharge device 22).

(2) Simultaneously, an actuation stopping timer 338 for stopping the actuation of the transfer corona-discharge device 26 is actuated. After the lapse of a predetermined period of time $t_2$, the timer 338 produces an output signal thereby to stop the actuation of the circuit 336 for energizing the transfer corona discharge device and stop the actuation of the charging corona discharge device 26.

The time from the stopping of the actuation of the transfer corona discharge device 22 to the stopping of the actuation of the corona discharge device 26, that is the time $t_2$ defined by the actuation stopping timer 338, can be set at or adjusted to a value substantially equal to, or slightly longer than, the time $t_1$ defined by the actuation starting timer 334.

On the other hand, as can be understood for FIG. 19, the original-illuminating lamp 36 turned on by the closing of the normally open switch 290 is turned off when the original-support mechanism 4 further makes a scanning movement and the lock releasing piece 302 (FIG. 16-D) acts on the locking means 294 to return the pivoting piece 288 to the inoperative position (i.e., the position shown in FIGS. 15 and 16-A) and bring the normally open switch 290 to the open state. If desired, it is possible to employ additionally such a construction that the illuminating lamp 36 is turned off, for example immediately after the stopping of the actuation of the charging corona discharge device 22.

In the electrostatic copying apparatus including the aforesaid control system, the charging corona discharge device 22 for charging purposes is actuated only for a period of time which corresponds to the longitudinal size of a copying paper which is contained in the cassette 50 set at the cassette-receiving section 48 and is transferred through the transfer zone 20. Hence, the longitudinal size (the size in the rotating direction of the rotary drum 12) of a latent electrostatic image formed on the photo-sensitive member 70 (FIG. 3) on the rotary drum 12 and of a visible image obtained by developing the latent electrostatic image correspond respectively to the longitudinal size of the copying paper transferred through the transfer zone 20. Thus, in the transferring operation in the transfer zone 20, substantially the entire region of the visible image on the photosensitive member 70 is transferred to the copying paper. This is in contrast to a conventional electrostatic copying apparatus in which a part of the visible image on the photosensitive member 70 may not be transferred to the copying paper but remain there. For this reason, the residual charge and toner particles remaining on the photosensitive member 70 after the transfer operation can be surely removed by suitable means such as the charge eliminating corona discharge device 28, the charge-eliminating lamp 30 and the developing device 24 which also function as a cleaning means. For example, when the copying process is carried out successively through a plurality of cycles in the illustrated electrostatic copying apparatus (that is, when multiple copies are to be obtained from a single original document), the rotary drum 12 is rotated through two turns in each copying cycle (after rotating the rotary drum 12 through two turns in the final copying cycle, it is possible, if desired, to rotate the rotary drum 12 further through at least one turn, thereby excerting an additional action of removing the residual charge and toner particles). At this time, it is possible to cause the charge-eliminating corona-discharge device 28 and the charge-eliminating lamp 30 to act once on the photosensitive member 70 and simultaneously to cause the developing device 24 to act once as a cleaning means. By causing these means to act only once, the residual charge and toner particles can be fully removed from the photosensitive member 70 after the transfer operation.

As stated hereinabove with reference to FIGS. 12 and 13, the illustrated electrostatic copying apparatus may also be constructed such that instead of the paper cassette 50, the manual paper-positioning mechanism 250 is mounted to the cassette-receiving section 48 to transfer a copying paper of an arbitrary size through the transfer zone 20. In this case, the sensing means in the paper size detecting means, i.e. the reed switches 268*a* and 268*b*, produces the same paper size signal as it produces when the B4-size paper cassette 50 (B4) is mounted to the cassette-receiving section 48, and therefore, the charging corona-discharge device 22 is actuated only for a period of time corresponding to the longitudinal size of a B4-size copying paper. If, therefore, a copying paper to be positioned by utilizing the manual paper-positioning mechanism 250 is smaller than the B4-size, the longitudinal size of a visible image formed on the photosensitive member 70 is larger than the longitudinal size of the copying paper, and it may therefore happen that a part of the visible image on the photosensitive member 70 will not be transferred to the copying paper but remain on the photosensitive member 70 after the transferring operation. However, when the manual paper-positioning mechanism 250 is utilized, successive multiple copying cycles are intrinsically not performed. When one copying cycle is carried out at intermittent times, there is no particular inconvenience even when the rotary drum 12 is rotated through at least three turns for each copying cycle to remove the residual charge and toner particles on the photosensitive member 70 repeatedly. By this operation, the relatively large amounts of residual charges and toner particles can be fully removed.

Furthermore, in the electrostatic copying apparatus including the aforesaid control system, the transfer corona discharge device 26 is also actuated only for a period of time corresponding to the longitudinal size of a copying paper transferred through the transfer zone 20, and therefore it is possible to avoid any adverse effect on the photosensitive mamber 70 of direct corona discharge which may be applied by the transfer corona discharge device 26 when no copying paper exists in the transfer zone 20.

The illustrated electrostatic copying apparatus is of a so-called cassette paper feeding type wherein a sheet-like copying paper is fed from the cassette 50 mounted to the cassette receiving section 48. The basic technical idea that the charging corona-discharge device 22 (and the transfer corona-discharge device 26) are actuated only for a period of time which correspond to the longitudinal size of a copying paper transferred through the transfer zone 20 can also be applied to an electrostatic copying apparatus of a so-called roll paper feeding type in which a roll-like copying paper is unwound, cut to the required size and transferred through the transfer zone 20. In this case, it is possible to detect the longitudinal size of the unwound and cut paper and to control the actuation of the charging corona discharge device 22 (and the transfer corona discharge device 26) according to the detected longitudinal size of the copying paper.

Furthermore, the illustrated electrostatic copying apparatus is of the so-called visbile image transfer type in which a latent electrostatic image formed on the photosensitive member 70 is developed and the developed image is transferred to a copying paper. However, the basic technical concept that the charging corona-discharge device 22 is actuated only for a period of time corresponding to the longitudinal size of a copying paper transferred through the transfer zone 20 can also be applied to an electrostatic copying apparatus of a so-called latent electrostatic image transfer type in which the latent electrostatic image formed on the photosensitive member 70 is transferred to a copying paper without development.

INHIBITION OF CHANGES IN THE STATE OF ELECTRIC CURRENT SUPPLY TO THE HEATER IN THE FIXING MECHANISM

Figure 9:
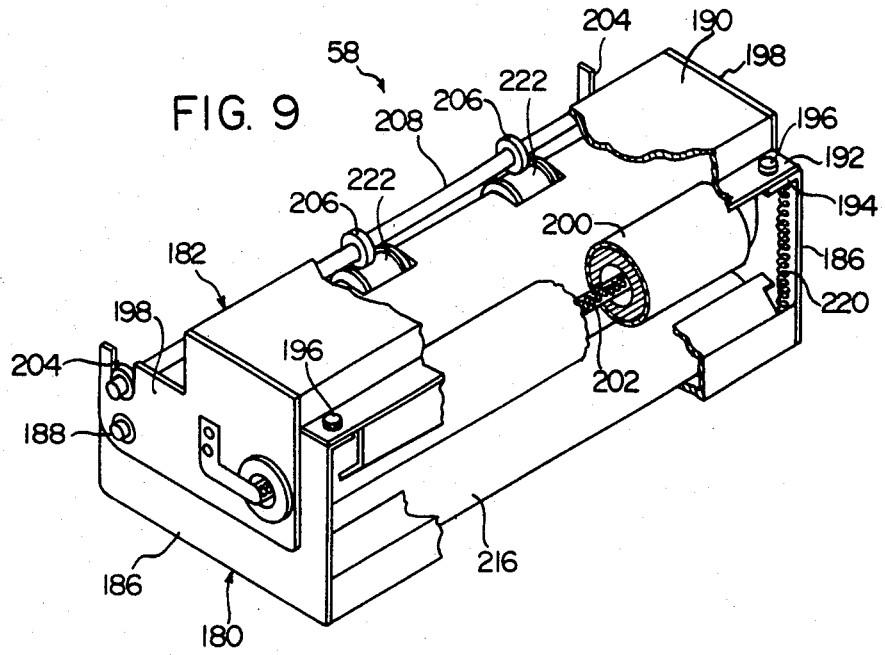
FIG. 9 is a perspective view, partly broken away, of a fixing mechanism used in the electrostatic copying apparatus shown in FIGS. 1 and 2.

As stated with reference to FIGS. 9 and 10, the illustrated electrostatic copying apparatus is provided with the fixing mechanism 58 having the electric heater 202. It is well known to those skilled in the art that in such a fixing mechanism 58, the supply of an electric current to the heater 202 which is started by the closing of the main switch (not shown) of the electrostatic copying apparatus is generally controlled properly according to the temperature of the fixing mechanism 58 in order to maintain the temperature of the fixing mechanism 58 within a required range. For example, this control is effected such that the current supply is interrupted when the temperature of the fixing mechanism 58 rises above a certain limit, and is resumed when the temperature of the fixing mechanism 58 decreases below the limit. Alternatively, the current is supplied in the alternating-current half-wave state when the temperature of the fixing mechanism 58 exceeds the limit, and is supplied in the alternating-current full-wave state when the temperature of the fixing mechanism 58 falls below the limit.

When a change occurs in the state of a current supply to the heater 202 of the fixing mechanism 58 during the formation of a latent electrostatic image on the photosensitive member 70 or during the transfer of a visible image on the photosensitive member 70 to a copying paper, the power supply source of the electrostatic copying apparatus undergoes influences and some variations occur in the operations of electrical elements such as the original-illuminating lamp 36 of the optical unit 32 or the charging corona-discharge device 22 and the transfer corona-discharge device 26. This is likely to result in non-uniformity in the formation of the latent electrostatic image or the transfer of the visible image.

In order to prevent occurrence of such a trouble, the apparatus of this invention, in one aspect thereof, includes a current supply change inhibiting means which maintains the state of current supply to the heater 202 of the fixing mechanism 58 in a certain predetermined state while at least one of the corona discharge devices 22 and 26 is in operation and therefore from the starting of formation of the latent electrostatic image until the end of the transfer of the developed image.

As can be appreciated easily from FIGS. 18 and 19, when at least one of the corona discharge devices 22 and 26 is actuated in the illustrated electrostatic copying apparatus, a signal is put into a temperature control means 340 which properly controls the state of current supply to the heater 202 of the fixing mechanism 58 according to the temperature of the fixing mechanism 58. This input signal causes the temperature control means 340 to interrupt current supply to the heater 202, and this state in maintained while the input signal exists.

Instead of causing the temperature control means 340 to interrupt current supply to the heater 202 and be maintained in this state by the input signal, it is also possible, if desired, to cause the temperature control means 340 to continue current supply to the heater 202 (in the alternating-current full-wave state or the alternating-current half-wave state) and be maintained in this state by the input signal. Alternatively, the state of the temperature control means 340 at the time of production of the input signal may be maintained without particularly changing it.

CONTROLLING OF THE TONER PARTICLE DISPENSING IN THE DEVELOPING DEVICE

The illustrated electrostatic copying apparatus further includes a toner particle dispensing control means shown generally t 342 in FIG. 18 which actuates the toner particle dispenser 100 in the developing apparatus 24 described with reference to FIGS. 5 to 8 only for a time period which corresponds to the longitudinal size of a copying paper transferred through the transfer zone 20 (FIG. 2).

Referring to FIG. 18, the toner particle dispensing control means 342 includes a counter 344, a first clock pulse oscillator 346, a second clock pulse oscillator 348 and a circuit 350 for energizing a toner particle dispensing electric motor (an electric motor shown at 136 in FIGS. 6 to 8). The first clock pulse oscillator 346 and the second clock pulse oscillator 348 are connected to the counter 344 through a gate element controlled by a signal from the reed switch **268*a*. As can be easily understood from FIG. 18, when the reed switch 268*a* is open [and therefore when the A5-size paper cassette 50 (A5) shown in FIG. 14-A or the A4-size paper cassette 50 (A4) shown in FIG. 14-C is mounted to the cassette-receiving section 48 (FIG. 2)], a clock pulse produced by the first clock pulse oscillator 346 is fed to the counter 344. Conversely, when the reed switch 268*a* is closed and therefore the B5-size paper cassette 50 (B5) shown in FIG. 14-B or the B4-size paper cassette 50 (B4) shown in FIG. 14-D is mounted to the cassette-receiving section 48 (FIG. 2), a clock pulse generated by the second clock pulse oscillator 348 is fed into the counter 344. The period of the clock pulse generated by the first clock pulse oscillator 346 is set at the time required to dispense an amount of toner particles 140 which corresponds to the amount of toner particles 140 consumed in developing a latent electrostatic image according to a standard A5-size original document (that is, the time of rotation required for the paper feed roller 126 to dispense the aforesaid amount of toner particles 140 from the toner particle dispenser 100 to the developer receptacle 94 in the developing device 24 shown in FIGS. 5 to 8). The period of the clock pulse generated by the second clock pulse oscillator 348 is set at the time required to dispense an amount of the toner particles 140 which corresponds to the amount of the toner particles 140** consumed in developing a latent electrostatic image according to a standard B5-size original document.

The reed switch **268*b* is connected further to the counter 344. When the reed switch 268*b* is open and therefore the A5-size paper cassette 50 (A5) shown in FIG. 14-A or the B5-size paper cassette 50 (B5) is mounted to the cassette-receiving section 48 (FIG. 2), once the counter 344 is actuated as described below, it is maintained in the actuated state only for one period of the clock pulse fed from the first or second clock pulse oscillator 346 or 348. Conversely, when the reed switch 268*b* is closed and therefore the A4-size paper cassette 50 (A4) shown in FIG. 14-C or the B4-size paper cassette 50 (B4) shown in FIG. 14-D is mounted to the cassette-receiving section 48 (FIG. 2), once the counter 344 is actuated as described below, the counter 344 is maintained in the actuated state for two periods of the clock pulse fed from the first or second clock pulse oscillator 346 or 348**.

Because of the above construction, it will be apparent that once the counter 344 is set into operation, it is maintained in the actuated state for one period of the clock pulse generated by the first clock pulse oscillator 346 (therefore, for the time required to dispense an amount of the toner particles 140 which corresponds to the amount of the toner particles 140 consumed in developing a latent electrostatic image according to a standard A5-size original document) when the A5-size paper cassette 50 (A5) is mounted to the cassette-receiving section 48; for one period of the clock pulse generated by the second clock pulse oscillator 348 (therefore, for the time required to dispense an amount of the toner particles 140 which corresponds to the amount of the toner particles 140 consumed in developing a latent electrostatic image according to a standard B5-size original document) when the B5-size paper cassette 50 (B5) is mounted to the cassette-receiving section 48; for 2 periods of the clock pulse generated by the first clock pulse oscillator 346 (therefore, for the time required to dispense an amount of the toner particles 140 which corresponds to the amount of the toner particles 140 consumed in developing a latent electrostatic image corresponding to a standard A4-size original document) when the A4-size paper cassette 50 (A4) is mounted to the cassette-receiving section 48; and for two periods of the clock pulse generated by the second clock pulse oscillator 348 (therefore, for the time required to dispense an amount of the toner particles 140 which corresponds to the amount of the toner particles 140 consumed in developing a latent electrostatic image according to a standard B4-size original document) when the B4-size paper cassette 50 (B4) is mounted to the cassette-receiving section 48.

As can be easily understood from FIGS. 18 and 19, the counter 344 shown in FIG. 18 is started during the rise time of the clock pulse supplied from the first or second clock pulse oscillator 346 or 348 after the lapse of the delay time dt defined by the timer 328 (in the state shown in FIGS. 18 and 19, during the rise time of the clock pulse fed from the second clock pulse oscillator 348 because the B4-size paper cassette 50 (B4) is mounted) and is maintained in the actuated state for the period of time described hereinabove (for two periods of the clock pulse generated by the second clock pulse oscillator 348 in the state shown in FIGS. 18 and 19). While such counter 344 is maintained in the actuated state, the circuit 350 for energizing the electric motor for toner particle dispensing is maintained in the actuated state, and the electric motor 136 in the developing device 24 shown in FIGS. 5 to 8 is energized to rotationally drive the feed roller 126 for the period defined by the counter 344 and to dispense the toner particles 140 to the developer receptacle 94 from the receptacle 124 of the toner particle dispenser 100. Because of the aforesaid construction, in the illustrated electrostatic copying apparatus including the toner particle dispensing control means 342, an amount of the toner particles 140 which corresponds substantially to the size of a copying paper transferred through the transfer zone 20 (FIG. 2) and therefore the size of a latent electrostatic image formed on the photosensitive member 70 (FIG. 3), that is, the amount of the toner particles 140 consumed by the development, is dispensed to the developer receptacle 94 every time the copying process is performed.

WARNING OF INCOMPLETE DISPENSING OF TONER PARTICLES

In the developing device 24 (FIGS. 5 to 8) in the illustrated electrostatic copying apparatus, the toner particles 140 are normally dispensed to the developer receptacle 94 from the receptacle 124 of the toner particle dispenser 100 by dint of the toner particle dispensing control means 342 (FIG. 18) every time the copying process is performed. In addition, as mentioned hereinabove with reference to FIGS. 5 and 6, the developing device 24 has the switch mechanism 178 for detecting the amount of the developer 92 within the developer receptacle 94. When a sufficient amount of the developer 92 exists in the developer receptacle 94 and the dispensing of more toner particles 140 would make the amount of the developer 92 in the developer receptacle 94 excessive, a developer detecting means 352 (FIG. 20) consisting of an electrical circuit including the aforesaid switch mechanism 178 produces a signal of inhibiting dispensing of the toner particles 140 thereby to hamper the starting of the toner particle dispensing action by the control of the toner particle dispensing control means 342, namely the toner particle dispensing action according to the peformance of each copying cycle, and thereby to prevent the developer 92 in the developer receptacle 94 from becoming excessive (for the structure and operation of the switch mechanism 178 and related electrical circuits, see the specification and drawings of the above-cited Japanese Patent Application No. 22699/1980).

When the switch mechanism 178 is provided in the developing device 24, the toner particle dispensing action according to the performance of each copying cycle is controlled such that the toner particles 140 are supplied in an amount which corresponds to the amount of the toner particles 140 consumed by the development of a latent electrostatic image in each copying cycle but which is slightly large than the standard amount of the toner particles 140 actually consumed. This accurately prevents the amount of the developer 92 within the developer receptacle 94 from decreasing excessively.

In the developing device 24 constructed as described above, the copying process is repeated through a certain number of cycles so long as the toner particle dispenser 100 is in condition to perform a normal toner dispensing action. Accordingly, when the toner dispensing action has been repeated a certain number of times, the aforesaid signal of hampering toner particle dispensing is necessarily produced. However, in the event that the dispensing action of the toner particle dispenser 100 becomes imperfect because, for example, of the extreme reduction of the amount of the toner particles 140 remaining in the receptacle 124, the toner particles 140 are not dispensed as required for each copying cycle even when the copying process is repeated through a predetermined number of cycles. Hence, the aforesaid signal of hampering the toner particle dispensing is not produced.

In order to cope with this phenomenon, the developing device 24 used in the illustrated electrostatic copying apparatus is provided with a warning means which informs the operator of the imperfect action of the toner particle dispenser 100 by producing a warning signal in the event that the developer detecting means 352 (FIG. 20) does not produce the signal of hampering the toner particle dispensing even when the copying process is repeated a predetermined number of times.

Figure 20:
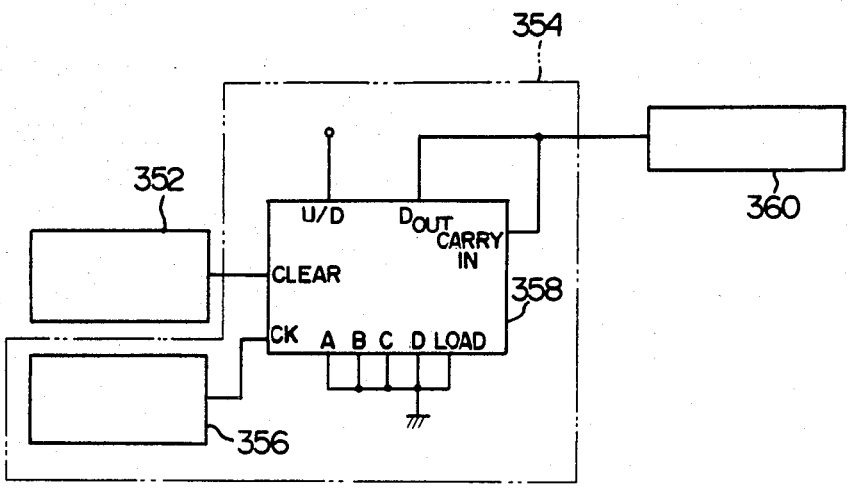
FIGS. 20 and 21 are block diagrams showing a part of a control electrical circuit used in the electrostatic copying apparatus shown in FIGS. 1 and 2.

Referring to FIG. 20, the warning means shown generally at 354 is comprised of a circuit 356 for detecting the number of copying cycles by producing one pulse signal for each copying cycle and a counter 358 which receives and counts the pulse signals generated by the circuit 356. To the counter 358 is connected the aforesaid developer detecting means 352, so that when the developer detecting means 352 produces the signal of hampering the toner particle dispensing, the counted value of the counter 358 will be cleared. The counter 358 itself is constructed such that it produces an output signal or a warning signal when it has counted an arbitrarily prescribed number (for example, 8).

In operation, when the developer detecting means 352 does not continuously produce the signal of hampering the toner dispensing (therefore, the counted value of the counter 358 is not cleared) despite the fact that the copying process has been repeated through a predetermined number of cycles, for example through eight cycles (therefore eight pulse signals have been fed to the counter 358 from the detecting circuit 356), the counted value of the counter 358 reaches 8 and the counter 358 produces a warning signal. The warning signal is fed to a warning display circuit 360 to actuate a warning lamp and/or a warning alarm, etc., thus informing the operator that the action of the toner dispenser 100 is imperfect and it should be corrected by, for example, supplying toner particles 140 to the receptacle 124.

PREPARATORY DRIVING AFTER ELIMINATION OF PAPER JAMMING

As those skilled in the art well know, the electrostatic copying machine is generally equipped with a paper jamming detecting means for detecting paper jamming which may occur in a paper transfer passage and producing a paper jamming signal, an emergency stop means for stopping the performance of the copying process by the electrostatic copying machine according to the paper jamming signal, and a manually operable release switch which, after elimination of a jammed paper, is manually operated to release the action of the emergency stop means and enable the copying process to be resumed.

The illustrated electrostatic copying apparatus, too, is provided with a paper jamming detecting means (not shown), an emergency stop means (not shown), and a manually operable release switch 362 (FIG. 21) which are of known structures.

Since a conventional electrostatic copying apparatus is constructed such that when the aforesaid manually operable release switch is operated after elimination of a jammed paper, a normal copying process will be resumed without any special action being performed, the following problem arises. For example, when paper jamming occurs while a part of a developed visible image on the photosensitive member remains there without being transferred to a copying paper, the copying process of the copying apparatus is also stopped immediately by the actions of the aforesaid detecting means and emergency stop means, and therefore, the copying process comes to an end while at least a part of the visible image remains on the photosensitive member. It will be readily appreciated that if in such a case the copying process is directly resumed after eliminating the jammed paper and operating the release switch, the next copying process continues without sufficient charge-eliminating and/or cleaning action on the remaining developed image in the previous copying cycle (that is, the copying cycle interrupted by the occurrence of paper jamming), and consequently, a latent electrostatic image and/or a developed visible image formed in the subsequent copying cycle is disordered by the residual charge and/or the residual toner particles occurring in the previous copying cycle.

In order to solve the above problem associated with the conventional electrostatic copying apparatus, the apparatus of this invention, in one aspect thereof, is provided with a preparatory driving means 364 which after eliminating paper jamming and releasing the stopping action of the emergency stop means (not shown) by operating the manually operable release switch 362 (FIG. 21), energizes the main electric motor 322 (FIG. 11) drivingly connected to the photosensitive member 70 (FIG. 3) thereby to move the photosensitive member 70 through at least one rotation.

Figure 21:
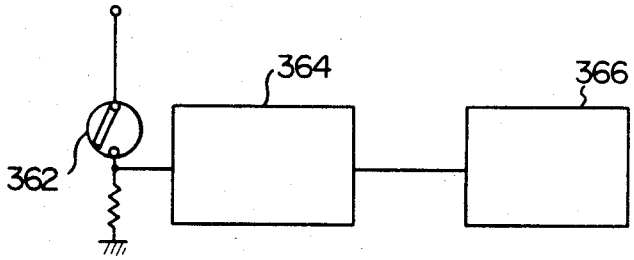

Referring to FIG. 21, the preparatory driving means 364 is made up of a timer which upon closing of the release switch 362 by a manual operation, is actuated for a period of time required to rotate the rotary drum 12 having the photosensitive member 70 thereon through at least one turn, preferably 2 or more turns. When actuated, the preparatory driving means 364 supplies a signal to a main electric motor-energizing circuit 366 and actuates it. When the main electric motor-energizing circuit 366 is actuated, the main electric motor 232 (FIG. 11) is energized thereby rotating the rotary drum 12 and actuating the developing device 24 which also functions as a cleaning means in the illustrated electrostatic copying apparatus. In addition, in the illustrated electrostatic copying apparatus, when the main electric motor-energizing circuit 366 is actuated, the charge-eliminating corona discharge device 28 and the charge-eliminating lamp 30 (FIG. 2) are also actuated.

Accordingly, in the illustrated electrostatic copying apparatus provided with the preparatory driving means 364 according to one aspect of this invention, when the copying process is stopped by paper jamming and the release switch 362 is operated after elimination of paper jamming, the action of the preparatory driving means 364 causes the rotary drum 12 to rotate through at least one turn, preferably two or more turns. Simultaneously, during the rotation of the rotary drum 12, the developing device 24 which also functions as a cleaning means and the charge-eliminating corona discharge device 28 and the charge-eliminating lamp 30 are actuated. Consequently, the residual charge and/or the toner particles on the photosensitive member 70 (FIG. 3) from the previous copying cycle interrupted by paper jamming can be fully removed prior to the performance of the next cycle of copying.

While the illustrated electrostatic copying apparatus is of the so-called visible image transfer type, it will be evident that the aforesaid preparatory driving means 364 can also be applied to electrostatic copying apparatus of the latent electrostatic image transfer type.

One specific embodiment of the electrostatic copying apparatus constructed in accordance with the present invention has been described in detail hereinabove with reference to the accompanying drawings. It should be understood that the invention is in no way limited to such a specific embodiment alone, and various changes and modifications are possible without departing from the scope and spirit of the invention.

What we claim is:

1. In an electrostatic apparatus comprising a housing, a photosensitive member disposed within the housing, a main electric motor driving connected to the photosensitive member for free movement of the photosensitive member through an endless moving path defined within the housing, an original-support mechanism disposed on the top surface of the housing and including a transparent plate on which to place an original document to be copied, a charging corona-discharge device for applying corona discharge to the photosensitive member in a latent electrostatic image-forming zone located along the moving path of the photosensitive member, an optical unit for projecting the image of the original document placed on the transparent plate onto the photosensitive member in the latent electrostatic image-forming zone, a copying paper transfer unit for transferring a copying paper through a predetermined transfer passage extending through a transfer zone located along the moving path of the photosensitive member and downstream of the latent electrostatic image-forming zone in the moving direction of the photosensitive member, a paper jamming detecting means for detecting the jamming of the copying paper in the transfer passage and thus producing a paper jamming signal, an emergency stopping means for stopping the copying process in response to the paper jamming signal, and a manually operable release switch for releasing the stopping action of the emergency stopping means; the improvement wherein the apparatus further comprises a preparatory driving means which, upon the releasing of the stopping action of the emergency stopping means by the operation of the release switch, energizes the main electric motor, thereby moving the photosensitive member through at least one rotation through said endless moving path, and (b) cleaning means responsive to releasing of the stopping action of the emergency stopping means by the operation of the release switch for cleaning said photosensitive member during the at least one rotation of said photosensitive member through said endless moving path.

2. An improved apparatus according to claim 1 wherein the preparatory driving means is comprised of a timer which acts only for a predetermined period of time from the time of operation of the manually operable release switch.

3. An improved apparatus according to claim 1 which further comprises a developing device for developing a latent electrostatic image formed on the photosensitive member by applying toner particles thereto in a developing zone located along the moving path of the photosensitive member and, viewed in the moving direction of the photosensitive member, both downstream of the latent electrostatic image-forming zone and upstream of the transfer zone, said developing device including a magnetic brush-type developer applicator mechanism having a cylindrical rotary sleeve drivingly connected to the main electric motor and a magnet disposed within the sleeve, the rotary sleeve being adapted to hold a developer on its peripheral surface by the action of a magnetic field generated by the magnet, and in which the developing device also performs a cleaning action of removing toner particles remaining on the photosensitive member after a developed visible image formed on the photosensitive member has been transferred to the copying paper in the transfer zone and the cleaning means actuates the developing means to perform the cleaning action in response to releasing of the stopping action of the emergency stopping means by the operation of the release switch.

4. An improved apparatus according to claim 1 which further comprises a developing device for developing a latent electrostatic image formed on the photosensitive member by applying toner particles thereto in a developing zone located along the moving path of the photosensitive member and, viewed in the moving direction of the photosensitive member, both downstream of the latent electrostatic image-forming zone and upstream of the transfer zone, said developing device including a magnetic brush-type developer applicator mechanism having a cylindrical rotary sleeve drivingly connected to the main electric motor and a magnet disposed within the sleeve, the rotary sleeve being adapted to hold a developer on its peripheral surface by the action of a magnetic field generated by the magnet, and in which the developing device also performs a cleaning action of removing toner particles remaining on the photosensitive member after a developed visible image formed on the photosensitive member has been transferred to the copying paper in the transfer zone and the cleaning means actuates the developing means to perform the cleaning action in response to releasing of the stopping action of the emergency stopping means by the operation of the release switch, and wherein the preparatory driving means is comprised of a timer which acts only for a predetermined period of time from the time of operation of the manually operable release switch.

* * * * *